US009429001B2

(12) United States Patent
Best

(10) Patent No.: US 9,429,001 B2
(45) **Date of Patent: *Aug. 30, 2016**

(54) SYNCHRONIZED PUMP DOWN CONTROL FOR A DUAL WELL UNIT WITH REGENERATIVE ASSIST

(71) Applicant: Flotek Hydralift, Inc., Houston, TX (US)

(72) Inventor: Larry D Best, Springtown, TX (US)

(73) Assignee: Flotek Hydralift, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/741,302

(22) Filed: Jun. 16, 2015

(65) Prior Publication Data

US 2015/0292307 A1 Oct. 15, 2015

Related U.S. Application Data

(63) Continuation of application No. 14/231,331, filed on Mar. 31, 2014, now Pat. No. 9,115,705, and a continuation-in-part of application No. 14/016,215, filed on Sep. 2, 2013, now abandoned, which is a continuation-in-part of application No. 13/608,132, filed on Sep. 10, 2012, now Pat. No. 8,523,533.

(60) Provisional application No. 61/809,294, filed on Apr. 5, 2013.

(51) Int. Cl.

| | |
|---|---|
| ***F04B 47/04*** | (2006.01) |
| ***E21B 43/12*** | (2006.01) |
| ***F04B 1/32*** | (2006.01) |

(Continued)

(52) U.S. Cl.

CPC ..... *E21B 43/126* (2013.01); *E21B 43/127* (2013.01); *E21B 43/129* (2013.01); *F04B 1/128* (2013.01); *F04B 1/143* (2013.01); *F04B 1/145* (2013.01); *F04B 1/146* (2013.01); *F04B 1/16* (2013.01); *F04B 1/32* (2013.01); *F04B 23/02* (2013.01); *F04B 23/04* (2013.01); *F04B 47/00* (2013.01); *F04B 47/04* (2013.01); *F04B 49/12* (2013.01)

(58) Field of Classification Search

CPC .... F04B 47/04; F04B 9/125; Y10S 417/904; E21B 43/126; E21B 43/127

See application file for complete search history.

(56) References Cited

U.S. PATENT DOCUMENTS 1,864,609 A * 6/1932 Musolf ..... F04B 47/04 417/399
2,612,142 A * 9/1952 Smith ..... F04B 47/04 417/904

(Continued)

FOREIGN PATENT DOCUMENTS

WO WO2015153432 A1 10/2015

*Primary Examiner* — Patrick Hamo
(74) *Attorney, Agent, or Firm* — Mark W Handley

(57) ABSTRACT

A dual well pumping unit (12) has two hydraulic ram units (26), one for each well, which are connected together for regenerative assist. Synchronized variable stroke and variable speed pump down control is provided, such that should pump down be encountered in one of the wells, programmable controllers (46) reduce the speed and the stroke of a ram unit (26) for a pumped-down well by the same percentage, to maintain a constant cycle time between upstrokes and down strokes such that the ram unit (26) of the pumped down well will remain synchronized with a ram unit (26) of the other well. Preferably the speed and the stroke of the ram unit (26) of the pumped down well will be decreased by 1.5% per stroke when pump down is detected, and will be increased by 3% per stroke until a constant fluid level is reached.

20 Claims, 17 Drawing Sheets

(51) Int. Cl.

| | |
|---|---|
| ***F04B 23/02*** | (2006.01) |
| ***F04B 23/04*** | (2006.01) |
| ***F04B 47/00*** | (2006.01) |
| ***F04B 1/12*** | (2006.01) |
| ***F04B 1/14*** | (2006.01) |
| ***F04B 1/16*** | (2006.01) |
| ***F04B 49/12*** | (2006.01) |

(56) References Cited

U.S. PATENT DOCUMENTS 2,699,154 A * 1/1955 Smith ..... F04B 47/04 417/904
2,770,197 A * 11/1956 Deitrickson ..... F04B 47/04 417/390
2,867,176 A * 1/1959 Porter ..... F04B 11/00 417/263
3,136,166 A * 6/1964 Journeay ..... F04B 47/02 188/296
3,212,406 A * 10/1965 McDuffie ..... F01L 25/063 417/403
3,364,864 A 1/1968 Gheorghe
4,076,458 A 2/1978 Jones
4,102,394 A 7/1978 Botts
4,145,161 A 3/1979 Skinner
4,191,514 A 3/1980 Ely et al.
4,350,080 A * 9/1982 Page, Jr. ..... F04B 47/04 417/342
4,392,792 A 7/1983 Rogers
4,427,348 A * 1/1984 Kofahl ..... F04B 3/00 417/342
4,480,685 A * 11/1984 Gilbertson ..... F04B 47/04 166/68.5
4,646,517 A * 3/1987 Wright ..... F04B 47/04 60/369
4,691,511 A * 9/1987 Dollison ..... F04B 47/04 60/414
4,973,226 A 11/1990 McKee
5,044,888 A 9/1991 Hester, II
5,259,731 A 11/1993 Dhindsa et al.
6,155,347 A 12/2000 Mills
6,213,722 B1 4/2001 Raos
6,213,733 B1 * 4/2001 Obrist ..... F04B 27/0891 417/269
6,454,542 B1 9/2002 Back
7,168,924 B2 1/2007 Beck
7,390,173 B2 * 6/2008 Pasquan ..... F04B 23/06 417/523
8,087,904 B2 * 1/2012 Best ..... E21B 43/126 166/67
8,523,533 B1 * 9/2013 Best ..... F04B 1/32 417/46
8,684,078 B2 4/2014 Boyles et al.
2008/0247844 A1 * 10/2008 Hartrampf ..... B21J 15/043 414/4

* cited by examiner

SYNCHRONIZED PUMP DOWN CONTROL FOR A DUAL WELL UNIT WITH REGENERATIVE ASSIST

CROSS-REFERENCE TO RELATED APPLICATION

The present application claims priority as a continuation of U.S. patent application Ser. No. 14/231,331, filed 31 Mar. 2014, which is a continuation-in-part of U.S. Provisional Patent Application Ser. No. 61/809,294, filed 5 Apr. 2013, and U.S. patent application Ser. No. 14/231,331, filed 31 Mar. 2014, is also a continuation-in-part to U.S. patent application Ser. No. 14/016,215, filed 2 Sep. 2013, which is a continuation of U.S. patent application Ser. No. 13/608,132, filed 10 Sep. 2012, which issued as U.S. Pat. No. 8,523,533 on Sep. 3, 2013, and wherein each of the forgoing invented by Larry D. Best, inventor of the present application.

TECHNICAL FIELD OF THE INVENTION

The present invention relates in general to pump units for oil wells, and in particular to a hydraulic pumping units having a regenerative assist.

BACKGROUND OF THE INVENTION

Hydraulic pumping units have been provided for pumping fluids from subterranean wells, such as oil wells. The pumping units have hydraulic power units and controls for the hydraulic power units. The hydraulic power units have an electric motor or a gas motor which powers a positive displacement pump to force hydraulic fluid into a hydraulic ram. The ram is stroked to an extended position to lift sucker rods within a well and provide a pump stroke. The ram lifts the weight of the sucker rods and the weight of the well fluids being lifted with the sucker rods. When the ram reaches the top of the pump stroke, the hydraulic fluid is released from within the ram at a controlled rate to lower the weight of the sucker rods into a downward position, ready for a subsequent pump stroke. The hydraulic fluid is released from the ram and returns to a fluid reservoir. Potential energy of the weight of the lifted sucker rods is released and not recovered when the hydraulic fluid is released from within the ram and returns directly to the fluid reservoir without being used to perform work.

Hydraulic assists are commonly used in hydraulic well pumping units to assist in supporting the weight of the sucker rods. Hydraulic accumulators are used in conjunction with one or more secondary hydraulic rams which are connected to primary hydraulic rams to provide an upward support force. The hydraulic accumulators are provided by containers having hydraulic fluids and nitrogen pre-charges ranging from one to several thousand pounds per square inch. Although the volumes of the containers are constant, the volume of the nitrogen charge region of the containers will vary depending upon the position of the ram piston rod during a stroke. At the top of an up stroke of the ram, the nitrogen charge region of a connected accumulator will have the largest volume, with the nitrogen having expanded to push hydraulic fluid from within the accumulator and into the secondary rams. At the bottom of a downstroke the nitrogen charge region will be at its smallest volume, compressed by hydraulic fluid being pushed from the secondary rams back into the accumulator. According to Boyle's Law, the pressure in the charge region is proportional to the inverse of the volume of the charge region, and thus the pressure will increase during the up stroke and decrease during the up stroke. This results in variations in the amount of sucker rod weight supported by the secondary hydraulic rams during each stroke of the ram pumping unit.

Drive motors for hydraulic pumps are sized to provide sufficient power for operating at maximum loads. Thus, motors for powering hydraulic pumps for prior art accumulator assisted pumping units are sized for lifting the sucker rod loads when the minimum load lifting assist is provided by the accumulator and the secondary ram. Larger variations in accumulator pressure and volume between the top of the up stroke and the bottom of the downstroke have resulted larger motors being required to power the hydraulic pump connected to the primary ram than would be required if the volume and pressure of the nitrogen charge section were subject to smaller variations. Large motors will burn more fuel or use more electricity than smaller motors. Several prior art accumulator containers may be coupled together to increase the volume of the nitrogen charge region in attempts to reduce variations in pressure between top of the up stroke and the bottom of the downstroke. This has resulted in a large number of accumulator containers being present at well heads, also resulting in increasing the number of hydraulic connections which may be subject to failure.

SUMMARY OF THE INVENTION

A synchronized dual well variable stroke and variable speed pump down control with regenerative assist is provided for pumping two, four or more wells. Should pump down be encountered in one of the wells, programmable controllers reduce the speed and the stroke of a ram unit for a pumped-down well by the same percentage, to maintain a constant cycle time between up strokes and down strokes such that the ram unit of the pumped down well will remain synchronized with a ram unit of the other well. Preferably the speed and the stroke of the ram unit of the pumped down well will be decreased by 1.5% per stroke when pump down is detected, and will be increased by 3% per stroke until a constant fluid level is reached.

A dual well assist for a hydraulic rod pumping units is disclosed which does not make use of secondary hydraulic rams, and which provides both downstroke energy recovery and synchronized variable stroke and speed pump down. Two variable displacement, positive displacement pumps are coupled to a single drive motor. The first pump is connected between a hydraulic fluid reservoir and a first hydraulic ram for a first pumping unit. The second pump is connected between the hydraulic fluid reservoir and a second hydraulic ram of a second pump unit. The first pump and the second pump are each connected to pump control units which automatically control the displacement of each of the pumps and selectively determine whether each of the pumps are operable as a hydraulic motor or a hydraulic pump. Preferably, the first and second pumps are variable displacement, open loop piston, hydraulic pumps which are modified for operating in reverse flow directions, such that the hydraulic fluid may pass from one of the two hydraulic rams, back into the respective pump discharge port, through the pump, through the pump suction port and into a fluid reservoir with the drive shaft for both of the hydraulic pumps and the rotor, or drive shaft, of the drive motor turning in the same angular direction as that for pumping the hydraulic fluid into respective ones of the two rams. Reversing the flow direction of the hydraulic fluid through the pumps selectively uses respective ones of the pumps as hydraulic motors which provides power for turning the other pump.

The pump control units determine actuation of the pumps for either pumping fluids or providing a hydraulic motor for turning the other pump, in combination with the power output by the drive motor. The pump control units are programmable controllers and each include a microprocessor which controls hydraulic motor displacement for each pump with feedback from provided by pump/motor displacement, a pressure transducer and a speed sensor. During the up stroke of the first well head pumping unit, the second pump is operated as a motor driven by the first pump and the power motor. The sucker rod load of the second well head pumping unit will in-part drive the second pump. During the down stroke of the first well head pumping unit, the second pump is operated as a pump that charges the second ram and the first pump is operated as a motor driven by the down stroke of the sucker rod load of the first well head pumping unit. This results in recovery of the potential energy stored by lifting the weight of the sucker rod assemblies during the up strokes in each of the wellhead pumping units. The hydraulic fluid from the ram units of the first or second wellhead pumping units are passed through respective ones of the first and second ram pumps in the reverse flow directions, with the pump control units actuating the respective pumps to act as a motor and assist the drive motor in driving the other pump.

Recovery of the potential energy from the suck rod weight provides two advantages. First is a lower energy requirement for powering the wellhead pumping units. A second advantage is that the size requirements for drive motors used to power the ram pumps of the wellhead pumping units is reduced, allowing smaller less expensive drive motors to be used. The discharges of both ram pumps are connected to an accumulator, which preferably has a nitrogen pre-charge region. The accumulator may also be engaged to provide additional assist on an up stroke, but is preferably only used for single well operation should one of the wells be taken out of service and shut in.

In one embodiment, a hydraulic ram for a ram pumping unit is mounted atop a support frame which has a self-aligning feature to prevent wear of the hydraulic ram. A lower end of the hydraulic ram is provided with a convex, rounded shape such as that of a spherical washer, which engages with a flange having an upwardly facing, dished face providing a concave surface for engaging with the convex surface of the lower end of the hydraulic ram. This provides for several degrees of self-alignment of the hydraulic ram with the applied sucker road load.

DESCRIPTION OF THE DRAWINGS

For a more complete understanding of the present invention and the advantages thereof, reference is now made to the following description taken in conjunction with the accompanying Drawings in which FIGS. 1 through 19 show various aspects for hydraulic rod pumping units having synchronized dual well variable stroke and variable speed pump down control with regenerative assist, as set forth below:

FIG. 1 is a schematic diagram depicting a side elevation view of the hydraulic rod pumping unit during an up stroke;

FIG. 2 is a schematic diagram depicting a side elevation view of the hydraulic rod pumping unit during a down-stroke;

FIG. 3 is a partial top view of the hydraulic rod pumping unit showing three hydraulic rams used in the unit;

FIG. 4 is a longitudinal section view of a variable volume piston pump which is operable in both conventional flow and reverse flow directions with the motor shaft continuously moving in the direction for pumping fluid;

FIGS. 5-8 illustrate various aspects of two dual well hydraulic ram pump systems providing regenerative assist which powered by a single prime mover or motor;

FIG. 10 is a schematic block diagram of calibration of stroke position and ram synchronization;

FIG. 11 is a schematic block diagram of variable stroke and speed pump down control for the dual well system;

FIG. 12 is a pump card illustrating pump down of a well;

FIGS. 13-15 show a well pump operating in various pump down conditions;

FIG. 16 illustrates multiple well system with regenerative assist power by a single prime mover or motor; and FIGS. 17-19 show a mounting configuration for a hydraulic ram of a pumping unit having self-aligning features between a hydraulic ram and a sucker rod assembly.

DETAILED DESCRIPTION OF THE INVENTION

Figure 1:
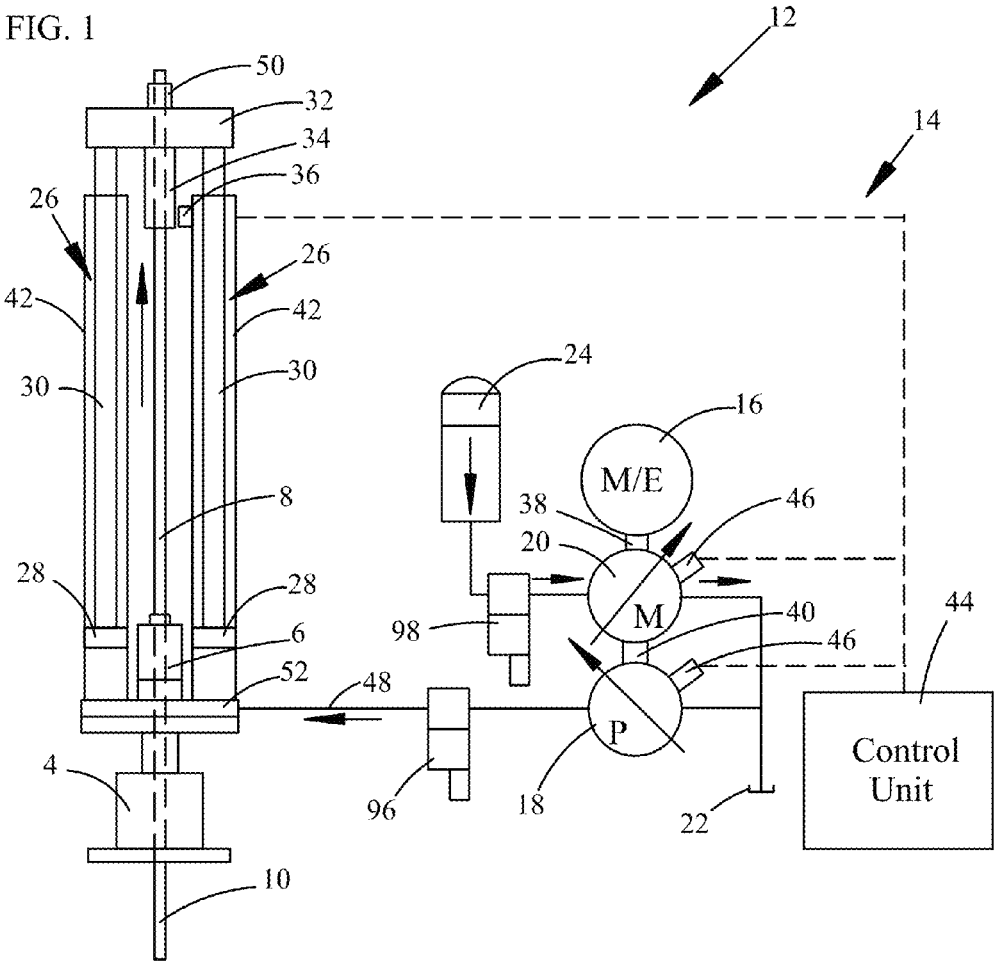
Figure 3:
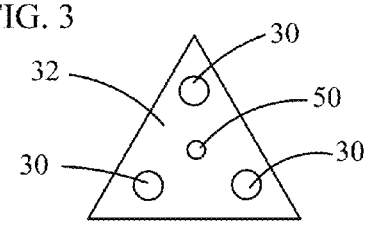
Figure 2:
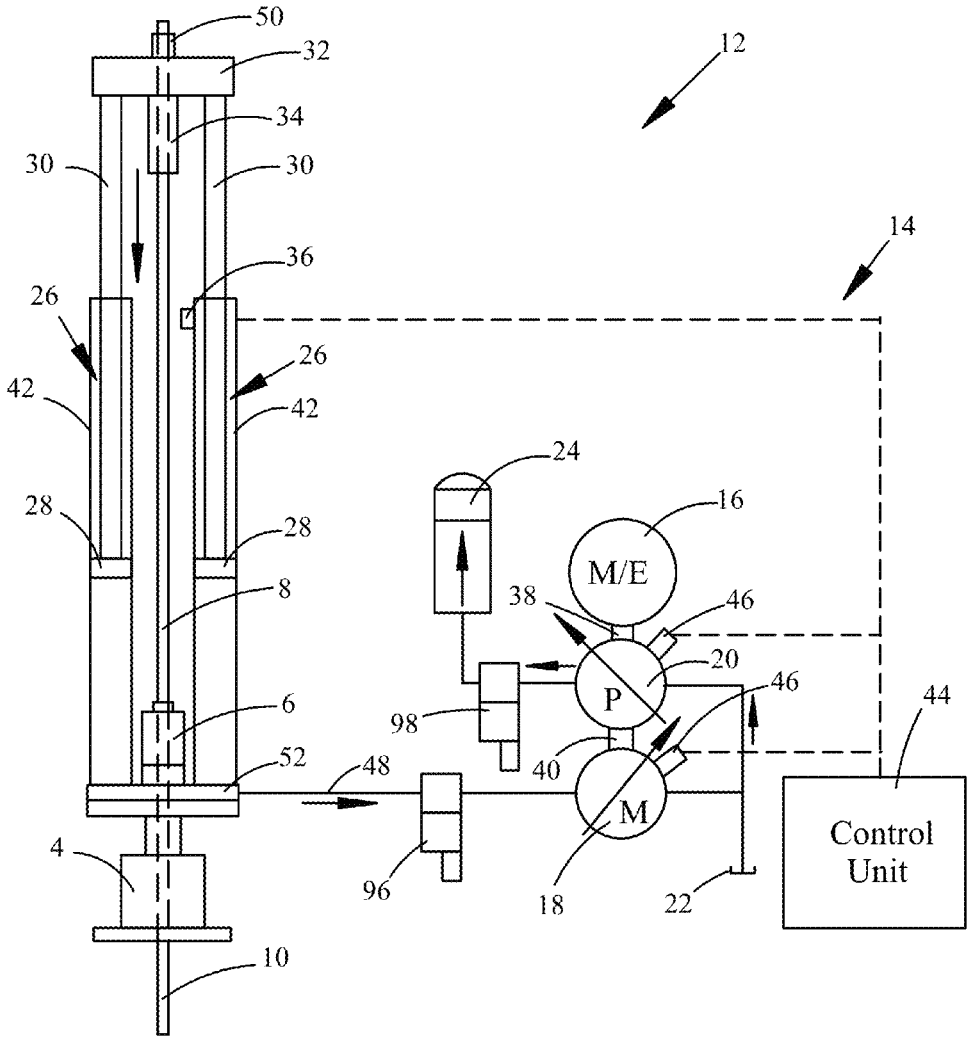

FIGS. 1 and 2 are schematic diagrams depicting a side elevation view of a hydraulic rod pumping unit 12 having a constant horsepower regenerative assist. FIG. 1 shows the pumping unit in an up stroke, and FIG. 2 shows the pumping unit in a down stroke. The pumping unit 12 is preferably a long stroke type pumping unit with heavy lift capabilities for pumping fluids from a well. The ram pumping unit 12 preferably has three single acting hydraulic rams 26, a sucker rod assembly 10, and a hydraulic power unit 14. FIG. 3 is a partial top view of the hydraulic rod pumping unit 12 and shows the three hydraulic rams 26 connected together by a plate 32 to which the piston rods 30 are rigidly connected. A polished rod 8 is suspended from the plate 32 by a polished rod clamp 50, and extends through a stuffing box 6 for passing into a well head 4 and connecting to sucker rods 10 of a downhole well pump for lifting fluids from the well.

Each of the hydraulic rams 26 has a piston guide 28 and a rod 30 which reciprocate within a cylinder 42. Preferably, the rod 30 provides the piston element within each of the hydraulic rams 26, and the piston guide 28 does not seal but rather centers the end of the rod 30 and provides bearings within the cylinder 42. The only hydraulic connection between the power unit 14 and the ram 26 is a single high pressure hose 48 which connects to a manifold plate 52, which ports fluid between each of the rams 26 and the hose 48. The hydraulic power unit 14 includes a drive motor 16, two variable volume piston pumps 18 and 20, a fluid reservoir 22, a hydraulic accumulator 24, and a control unit 44. The drive motor 16 may be an electric motor, or a diesel, gasoline or natural gas powered engine. The control unit 44 preferably includes a motor control center and a microprocessor based variable speed pump down system. The hydraulic accumulator 24 preferably is of a conventional type having a nitrogen charge region which varies in volume with pressure. The pump down system monitors the polished rod load and position to make appropriate speed adjustments to optimize production from the well while keeping operational costs at a minimum. The ram pump 18 and the accumulator pump 20 preferably each have a pump control unit 46 mounted directly to respective ones of the associated pumps housings. Valves 96 and 98 are provided for preventing hydraulic fluid from draining from the hydraulic rams 26 and the accumulator 24, respectively, when the drive motor 16 is not running.

The control unit 44 and the two pump control units 46 are provided for controlling operation of the pump 18 and the pump 20. The control unit 44 and the pump control units are programmable controllers each having a microprocessor and memory for both storing machine readable instructions and executing such instructions. The control unit 44 is preferably a microprocessor-based controller which is provided sensor inputs for calculating the stroke position of the piston rod 30 of the ram 26, and the polished rod load. The polished rod load is calculated from the measured hydraulic pressure and the weight of the sucker rods 10 at the well head 4. The control unit 44 will feed control signals to the pump control units 46, to vary the flow rate through respective ones of the pump 18 and the pump 20. The pump control units 46 are integral pump controllers which are preferably provided by microprocessor-based units that are mounted directly to respective ones of the pumps 18 and 20, such as such a Model 04EH Proportional Electrohydraulic Pressure and Flow Control available from Yuken Kogyo Co., Ltd. of Kanagawa, Japan, the manufacturer of the pumps 18 and 20 of the preferred embodiment. The Yuken Model 04EH pump controller includes a swash plate angle sensor and a pump pressure sensor, and provides control of each of the swash plate angles C and D (shown in FIG. 3) to separately control the pressure outputs and the flow rates of the hydraulic fluid through respective ones of the pumps 18 and 20.

Figure 4:
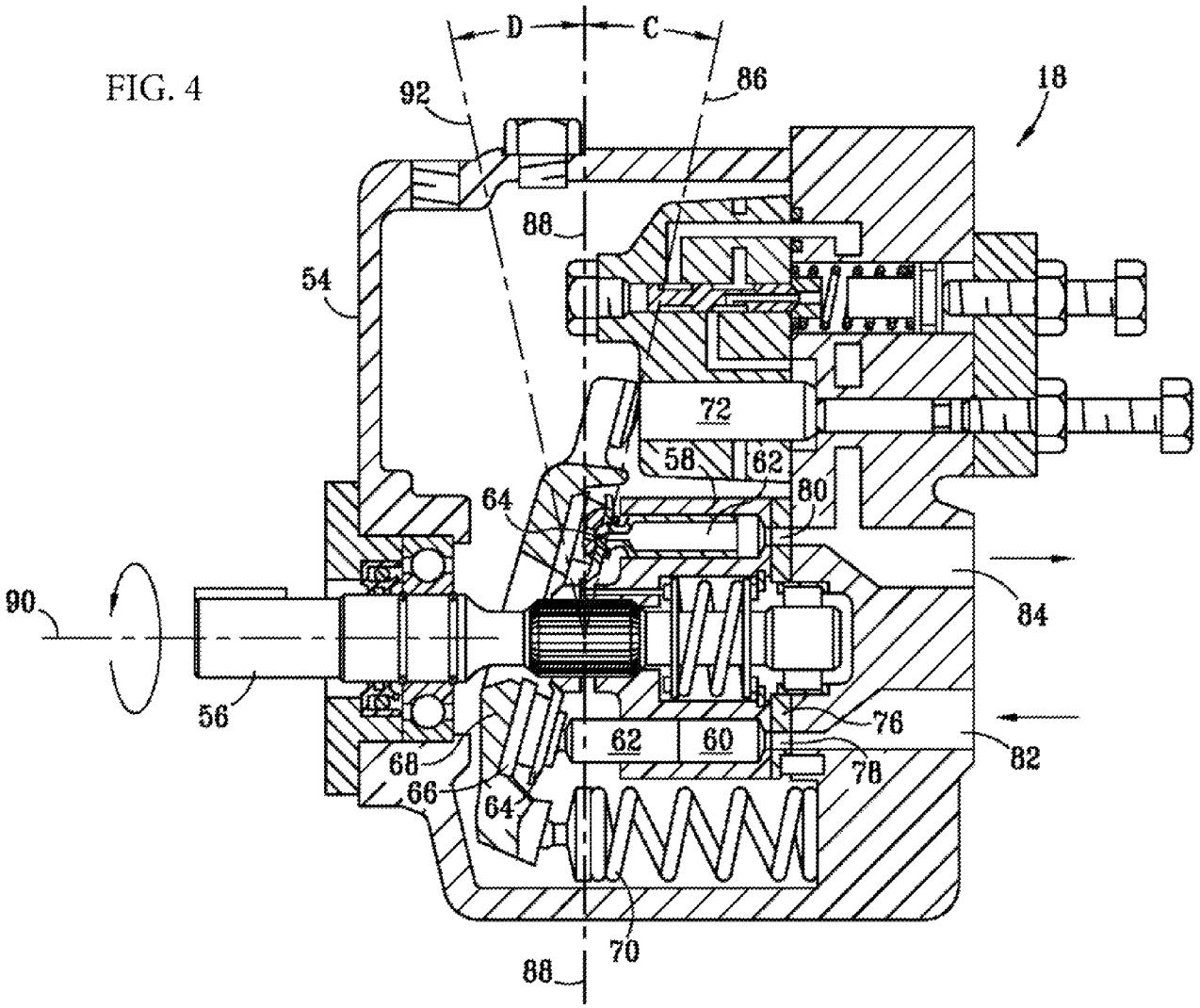

FIG. 4 is a longitudinal section view of the variable volume piston pump used for both the pump 18 and the pump 20. The pump is operable in both a conventional flow direction mode and a reverse flow direction mode, with a drive shaft 56 of the pump 18 and the rotor of the drive motor 16 continuously turning in the same angular direction for both flow directions. The pump 18 has a pump housing 54 within which is the drive shaft 56 is rotatably mounted. The pump drive shaft 56 is connected to the rotor of the drive motor 16 (shown in FIG. 1), in conventional fashion. A cylinder block 58 is mounted to the drive shaft 56, in fixed relation to the drive shaft 56 for rotating with the drive shaft 56. Preferably, a portion of the outer surface of the drive shaft 56 is splined for mating with splines in an interior bore of the cylinder block 58 to secure the drive shaft 56 and the cylinder block 58 in fixed relation. The cylinder block 58 has an inward end and an outward end. The inward end of the cylinder block 58 has a plurality of cylinders 60 formed therein, preferably aligned to extend in parallel, and spaced equal distances around and parallel to a centrally disposed, longitudinal axis 90 of the drive shaft 56. The drive shaft 56 and the cylinder block 58 rotate about the axis 90. Pistons 62 are slidably mounted within respective ones of the cylinders 60, and have outer ends which are disposed outward from the cylinders for engaging retainers 64. The retainers 64 secure the outer ends of the pistons 62 against the surface of a swash plate 66. The outward end of the cylinder block 58 is ported with fluid flow ports for passing hydraulic fluid from within the cylinders 60, through the outward end of the cylinder block 58. A port plate 76 is mounted in fixed relation within the pump housing 54, and engages the outward, ported end of the cylinder block 58. The port plate 76 has a first fluid flow port 78 and a second fluid flow port 80, with the first flow port 78 and the second flow port 80 connected to the pump suction port 82 and the pump discharge port 84. The suction port 82 and the discharge port 84 are defined according to conventional operation of the pumps 18 and 20, in moving hydraulic fluid from the fluid reservoir 22 and into the hydraulic ram 26. The pistons 62, the cylinders 60 and the cylinder block 58 rotate with a pump drive shaft 56, with the outer ends of the pistons 62 engaging the swash plate 66 and the ported end of the cylinder block 58 engaging the port plate 76.

The swash plate 66 is mounted to a yoke or a cradle 68, preferably in fixed relation to the cradle 68, with the swash plate 66 and the cradle 68 pivotally secured within the motor housing 54 for angularly moving about an axis which is perpendicular to the longitudinal axis 90 of the drive shaft 56. A bias piston 70 is mounted in the pump housing 54 to provide a spring member, or bias means, which presses against one side of the cradle 68 and urges the swash plate 66 into position to provide a maximum fluid displacement for the pump 18 when the pump 18 is operated in conventional flow direction mode to pump the hydraulic fluid from the fluid reservoir 22 into the hydraulic ram 26. A control piston 72 is mounted in the pump housing 54 on an opposite side of the pump drive shaft 56 from the bias piston 70 for pushing against the cradle 68 to move the cradle 68 and the swash plate 66 against the biasing force of the bias piston 70, minimizing fluid displacement for the pump 18, when the pump 18 operated in the conventional flow direction mode to pump the hydraulic fluid from the reservoir 22 into the hydraulic ram 26.

The swash plate 66 preferably has a planar face defining a plane 86 through which extends the central longitudinal axis 90 of the pump drive shaft 56. A centerline 88 defines a neutral position for the swash plate plane 86, with the centerline 88 is preferably defined for the pump 18 as being perpendicular to the longitudinal axis 90 of the drive shaft 56. When the swash plate 66 is disposed in the neutral position, the stroke length for the pistons 62 will be zero and the pump 18 will have zero displacement since the pistons 62 are not moving within the cylinder block 58, as the cylinder block 58 is rotating with the drive shaft longitudinal axis 90. When the swash plate 66 is in the zero stroke position, with an angle C between the swash plate plane 86 and the centerline 88 equal to zero, the pump 18 is said to be operating at center and fluid will not be moved. The angle C between the centerline 88 and the plane 80 of the swash plate 66 determines the displacement for the pump 18. Stroking the control piston moves the cradle 68 and the swash plate 66 from the neutral position, in which the plane 86 the swash plate 66 is aligned with the centerline 88, to a position in which the angle C is greater than zero for operating the pump 18 in the conventional flow mode to provide hydraulic fluid to the ram 26. The larger the angle C relative to the centerline 88, the larger the displacement of the pump 18 and the larger the volume of fluid moved by the pump 18 for a given speed and operating conditions.

If the plane 86 of the swash plate 66 is moved across the centerline 88 to an angle D, the pump swash plate 66 is defined herein to have moved across center for operating the pumps 18 and 20 over center as a hydraulic motor in the reverse flow mode. When the swash plate 66 is moved across center, the pumps 18 and 20 will no longer move fluid from the fluid reservoir 22 to respective ones of the hydraulic ram 26 and the accumulator 24, but instead will move the hydraulic fluid in the reverse flow direction, either from the hydraulic ram 26 to the fluid reservoir 22 or from the accumulator 24 to the fluid reservoir 22, for the same angular direction of rotation of the pump drive shafts 38, 40 and the rotor for the drive motor 16 as that for pumping hydraulic fluid into the hydraulic ram 26 or the accumulator 24. With fluid flow through the pump 18 reversed, the pressure of the hydraulic fluid in the hydraulic ram 26 may be released to turn the pump 18 as a hydraulic motor, which applies mechanical power to the drive shafts 38 and 40 connecting between the pumps 18 and 20, and the drive motor 16. Similarly, with fluid flow through the pump 20 reversed, the pressure of the hydraulic fluid in the accumulator may be released to turn the pump 20 as a hydraulic motor, which applies mechanical power to the drive shafts 38 and 40 connecting between the pumps 18 and 20, and the drive motor 16.

Referring to FIGS. 1 and 2, a position sensor 36 is provided for sensing the stroke position of the rod 30 within the cylinder 42 of the ram 26. The position sensor 36 is preferably provided by a proximity sensor which detects a switch actuator 34 to detect when the ram 26 is at a known position, such as at the bottom of the downstroke as shown in FIG. 1. The control unit 44 is operable to reset a calculated position to a known reference position which is determined when the sensor 36 detects the ram switch actuator 34. Then, the control unit 44 calculates the position of the piston rod 30 within the cylinder 42 by counting the stroke of pump 18 and angle of swash plate 66 within the pump 18, taking into account the volume of the rod 30 inserted into the cylinder 42 during the up stroke. The piston rod 30 acts as the piston element in each of the hydraulic rams 26, such that the cross-sectional area of the piston rod 30 times the length of the stroke of the rod 30 provides the volume of hydraulic fluid displaced during the stroke length. The angle of the swash plate 66 provides the displacement of the pump 18. The rpm at which the pump 18 is turned is known by either the synchronous speed of an electric motor, if an electric motor is used, which is most often 1800 rpm, or the speed set by the governor for a diesel or gas engine. The calculated stroke position is reset to a reference position near the bottom of the downstroke for the ram 26. From the known angular speed and measured angle of the swash plate 66 for selected time intervals, the controller 44 calculates the total flow of hydraulic fluid through the ram pump 18 from the time the piston rod 30 is a the known reference position as detected by the proximity sensor 36, and then determines the stroke for the piston rod according to the cross-sectional area of the piston rod 30.

During operation of the pumping unit 12, the load or weight of the piston rod 30 and the sucker rods 10 provide potential energy created by being lifted with hydraulic pressure applied to the hydraulic ram 26. The potential energy is recaptured by passing the hydraulic fluid from the ram 26 through the hydraulic pump 18, with the swash plate 66 for the pump 18 disposed over center such that the pump 18 acts as a hydraulic motor to apply power to the pump 20. The control unit 44 positions the swash plate 66 at the angle D from the centerline 88, such that the hydraulic pump 18 recaptures the potential energy stored by the raised sucker rods and powers the pump 20 to store energy in the hydraulic accumulator 24. Then, during the up stroke the potential energy stored in the accumulator 24 is recaptured by passing the hydraulic fluid from the accumulator 24 through the hydraulic pump 20, with the swash plate 66 for the pump 20 disposed over center such that the pump 20 acts as a hydraulic motor to apply power to the pump 20. The potential energy from the accumulator 23 is applied to the drive shafts 38 and 40 to assist the drive motor 24 in powering the pump 18 to power the ram 26 during the up stroke.

The control unit 44 will analyze data from both pressure on the hydraulic rams 26, and from the calculated the position of the piston rod 30, and will adjust the position of the swash plates 66 in each of the respective pumps 18 and 20 to control the motor displacement. This controls the rate of the oil metered from respective ones of the hydraulic ram 26 and the accumulator 24, thus controlling the down-stroke speed of the ram 26, the pump 18 and the pump 20, which provides a counterbalance for the weight of the sucker rod assembly 10 and may be operated to provide a constant horsepower assist for the drive motor 16. Increasing the displacement increases the speed and decreasing the displacement decreases the speed for the pump 18 and the pump 20, controlling the horsepower assist during an up stroke of the ram 26. During up stroke of the hydraulic ram 26, the drive motor 16 is operated to move the hydraulic fluid through the pump 18, from the suction port 82 to the discharge port 84 and to the ram 26. The up stroke speed of the pump 18 is controlled manually or is controlled automatically by a microprocessor-based control unit 44. During the downstroke of the hydraulic ram 26, the pump 18 is stroked over center by moving the swash plate 66 over center, and the hydraulic fluid will flow from the ram 26 into the port 84, through the pump 18 and then out the port 82 and into the reservoir 22, with the pump 18 acting as a hydraulic motor to drive the drive the pump 20, which assisted in providing provided power to the pump 18 for the up stroke. During the downstroke, the pump 20 will similarly provide power to assist turning the pump 18, with the control unit 44 controlling the angle of the swash plate 66 in the pump 20 and thus rate at which hydraulic fluid is released from the accumulator 24 and power is applied to the drive shafts 38 and 40.

The load on the piston rod 30 at various linear positions as calculated by the controller 44 and detection of the down bottom of stroke position by the proximity sensor 36 are also analyzed by the control unit 44 to automatically provide selected up-stroke and downstroke speeds, and acceleration and deceleration rates within each stroke, for optimum performance in pumping fluids from the well head 4. Should the well begin to pump down, the up-stroke and the downstroke speeds may be adjusted to maintain a constant fluid level within the well. The control unit 44 monitors key data and provides warnings of impending failure, including automatically stopping the pump from operating before a catastrophic failure. The load on the piston rod 30, or the polished rod load for the sucker rods 10 at the well head 4, is preferably determined by measuring hydraulic pressure in the hydraulic rams 26. Sensors may are also preferably provided to allow the control unit 44 to also monitor the speed of the pump drive shafts 38 and 40 and the rotor for the drive motor 16.

The hydraulic pump 18 is a variable displacement pump which is commercially available and requires modification for operation according to the present invention. Pump 18 is commercially available from Yuken Kogyo Co., Ltd. of Kanagawa, Japan, such as the Yuken model A series pumps. Other commercially available pumps may be modified for operating over center, in the reverse flow direction, such as a PD Series pump or a Gold Cup series pumps available from Parker Hannifin HPD, formerly Denison Hydraulics, Inc., of Marysville, Ohio, USA. The Gold cup series pump which uses a hydraulic vane chamber actuator for position a swash plate rather than the control piston of the Yuken model A series pump. The hydraulic vane chamber is preferably powered by a smaller hydraulic control pump connected to the drive shaft of the pumps 18 and 20, rather than being powered by the pumps 18 and 20. Hydraulic fluid is passed on either side of a moveable vane disposed in the vane chamber to move the vane within the chamber, and the vane is mechanically linked to a swash plate to move to swash plate to a desired position. In other embodiments, other type of actuators may be used to control the position of a swash plate relative to the centerline, such as pneumatic controls, electric switching, electric servomotor, and the like. The modifications for the pumps required for enabling operation according to the present invention are directed toward enabling the swash plates for the respective pumps to move over center, that is over the centerline, so that the pump may be operated over center in the review flow direction mode. The commercially available pumps were designed for use without the respective swash plates going over center, that is, they were designed and manufactured for operating in conventional flow direction modes and not for switching during use to operate in the reverse flow direction mode. Typical modifications include shortening sleeves for control pistons and power pistons, and the like. Internal hydraulic speed controls are also typically bypassed to allow operation over center. For the Denison Gold Cup series pumps, pump control manifolds may be changed to use manifolds from other pumps to allow operation of the pump over center. Closed loop pumps and systems may also be used, with such pumps modified to operate over center, in the reverse flow direction.

The hydraulic pumping unit having a constant horsepower regenerative assist provides advantages over the prior art. The pumping unit comprises a single acting hydraulic ram, without secondary rams provided for assist in lifting the sucker rod string. During a downstroke, the pumping unit provides for regeneration and recapture of energy used during the up stroke. The sucker rod load is used during the downstroke to power a ram pump which a controller has actuated to act as a hydraulic motor and provide useable energy for driving a accumulator pump to charge an accumulator. During the up stroke the pump controller actuates the accumulator pump to act as a motor and fluid released from the accumulator provides power for assisting the drive motor in powering the ram pump to raise the ram and lift the sucker rod string. Preferably, controller operates the pumps to determine the rate at which fluids flows from the ram and through the pump, such as by selectively positioning the swash plates for each of the hydraulic pumps to determine a counterbalance flow rate at which hydraulic fluid flows from the ram back into the ram pump and is returned to a reservoir, and the counterbalance flow rate at which the hydraulic fluid flows form the accumulator back into the accumulator pump and is returned to the reservoir. In other embodiments, valving may be utilized to control flow, or a combination of valving and pump controls.

Figure 5:
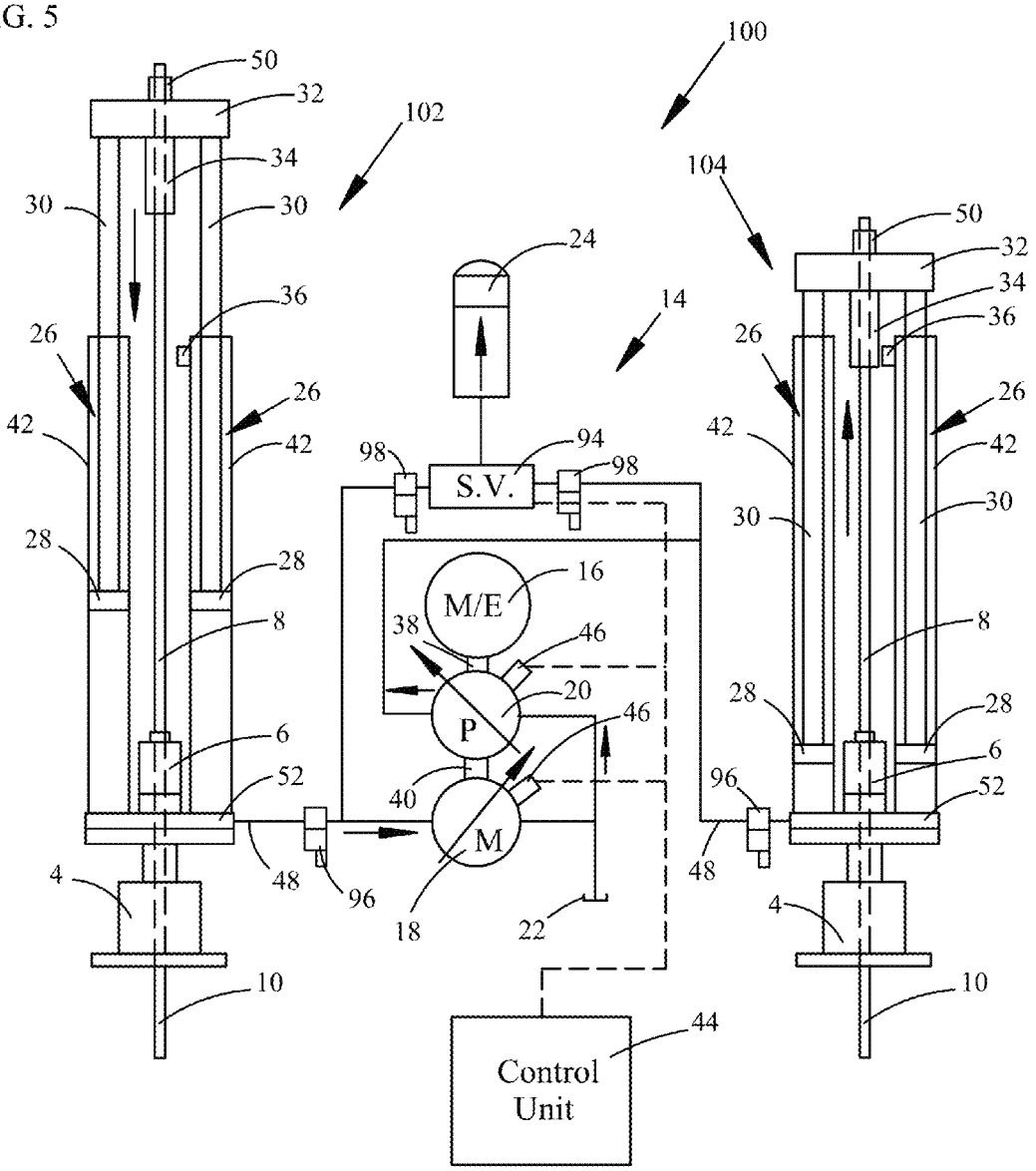
Figure 6:
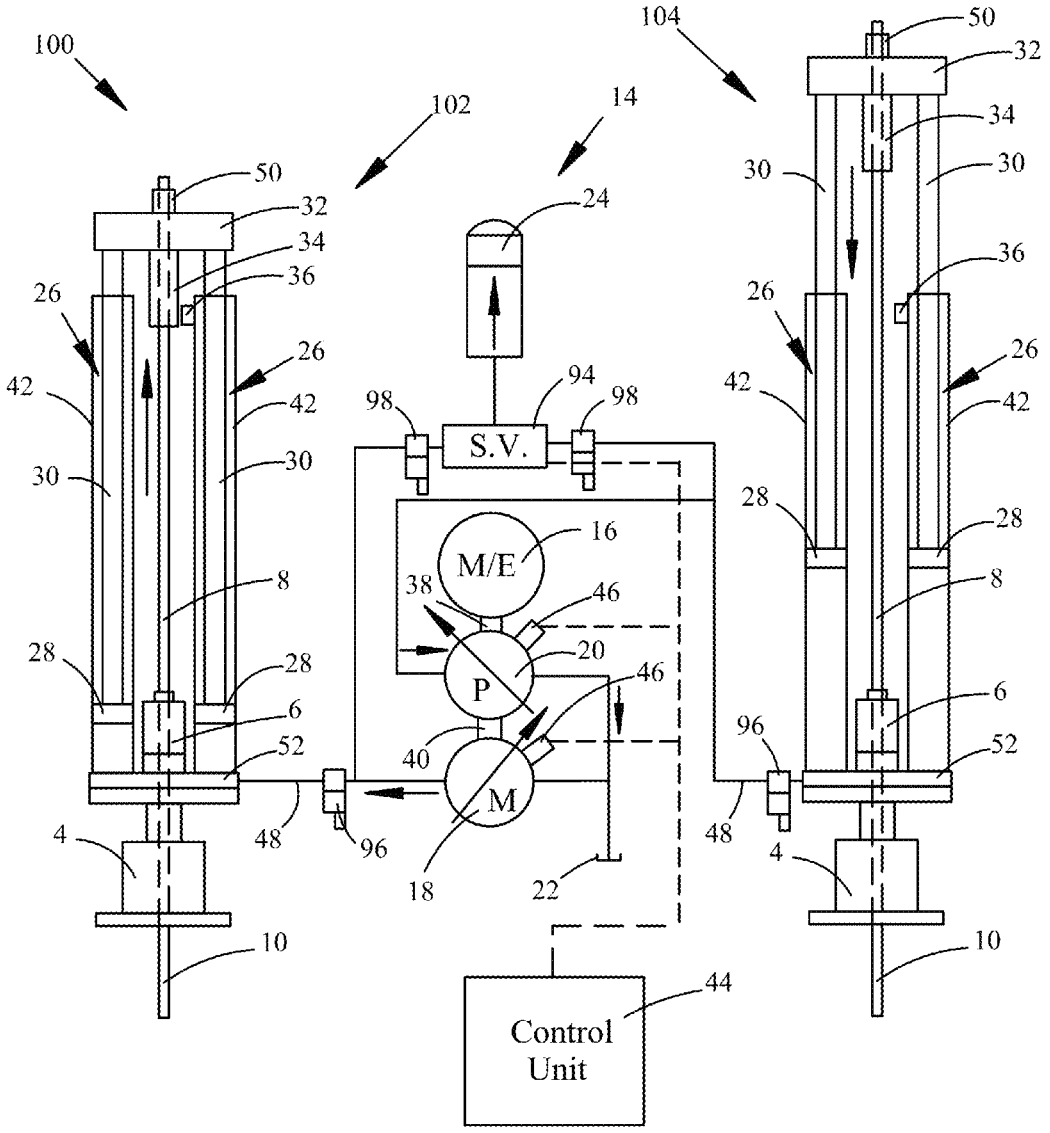

FIGS. 5-8 illustrate various aspects of a dual well system with regenerative assist with two wellhead pumping units connected to one primer move 16. Referring to FIGS. 5 and 6, a dual well regenerative system 100 has wellhead pumping units 102 and 104 with similar components as that of the standard single well pumping unit 12 and hydraulic power unit 14 of FIGS. 1-4 above, but which requires only one power unit 14 with one prime move 16 to power two separate well head pumps 102 and 104 for two wells. The hydraulic power unit 14 has the two hydraulic pumps 18 and 20, and the hydraulic accumulator 24, preferably provided by a nitrogen charge accumulator. The accumulator 24 may be used to store recovered potential energy should the assist from one pumping unit not be fully used for powering the other pumping unit. The shuttle valve 94 connects the high pressure side of the pumping units 102 and 104 to the accumulator 24. The solenoid valves 98 are also provided on opposite sides of the shuttle valve 94, and may also be used controlling flow between accumulator 24 and the pumping units 102 and 104 in place of the shuttle valve 94. Each of the ram pumps 18 and 20 has one of the pump control units 46 integrated with the respective pump housing. A control unit 44 is provided and connected to each of the pump control units 46, the position sensors 36 and fluid pressure sensors (not shown).

The pumping units 102 and 104 are synchronized such that one of the pumping units 102 and 104 will be on an up stroke while the other of the pumping units 102 and 104 is on a downstroke. The potential energy of the lifted weight of the sucker rod assembly of the well on the downstroke is recovered and used to provide assist to the other pumping unit which is on the up stroke. FIG. 5 shows the pumping unit 102 during a downstroke and the pumping unit 104 on an up stroke. The potential energy stored in the lifted the weight on the sucker rod 8 pushes hydraulic fluid from the hydraulic rams 26 of the pumping unit 102 and turns the pump 18. The pump 18 is actuated to an over-center condition and acts as a motor for assisting the drive motor 16 in turning the ram pump 20. The ram pump 20 is in a pump configuration for turning to force the hydraulic fluid into the hydraulic rams 26 of the pumping unit 104, lifting the sucker rod 8 of the pumping unit 104. Similarly, FIG. 6 shows the pumping unit 102 during an up stroke and the pumping unit 104 during a downstroke. The potential energy stored in the lifted the weight on the sucker rod 8 of the pumping unit 104 pushes hydraulic fluid from the hydraulic rams 26 of the pumping unit 104 and turns the pump 20. The pump 20 has been actuated to an over-center condition and acts as a motor for assisting in turning the pump 18. The ram pump 18 has been moved back from the over-center condition to operate as a pump and is turned by the ram pump 20 and the drive motor 16 to force the hydraulic fluid into the hydraulic ram 26 of the pumping unit 102, lifting the sucker rod 8 attached to the pumping unit 102. Thus, a first one of the wellhead pumping units 102 and 108 during a downstroke will counterbalance the second of the wellhead pumping units 102 and 108 during a downstroke, with the first providing regenerative assist to the second in lifting the respective sucker rods 8.

Figure 7:
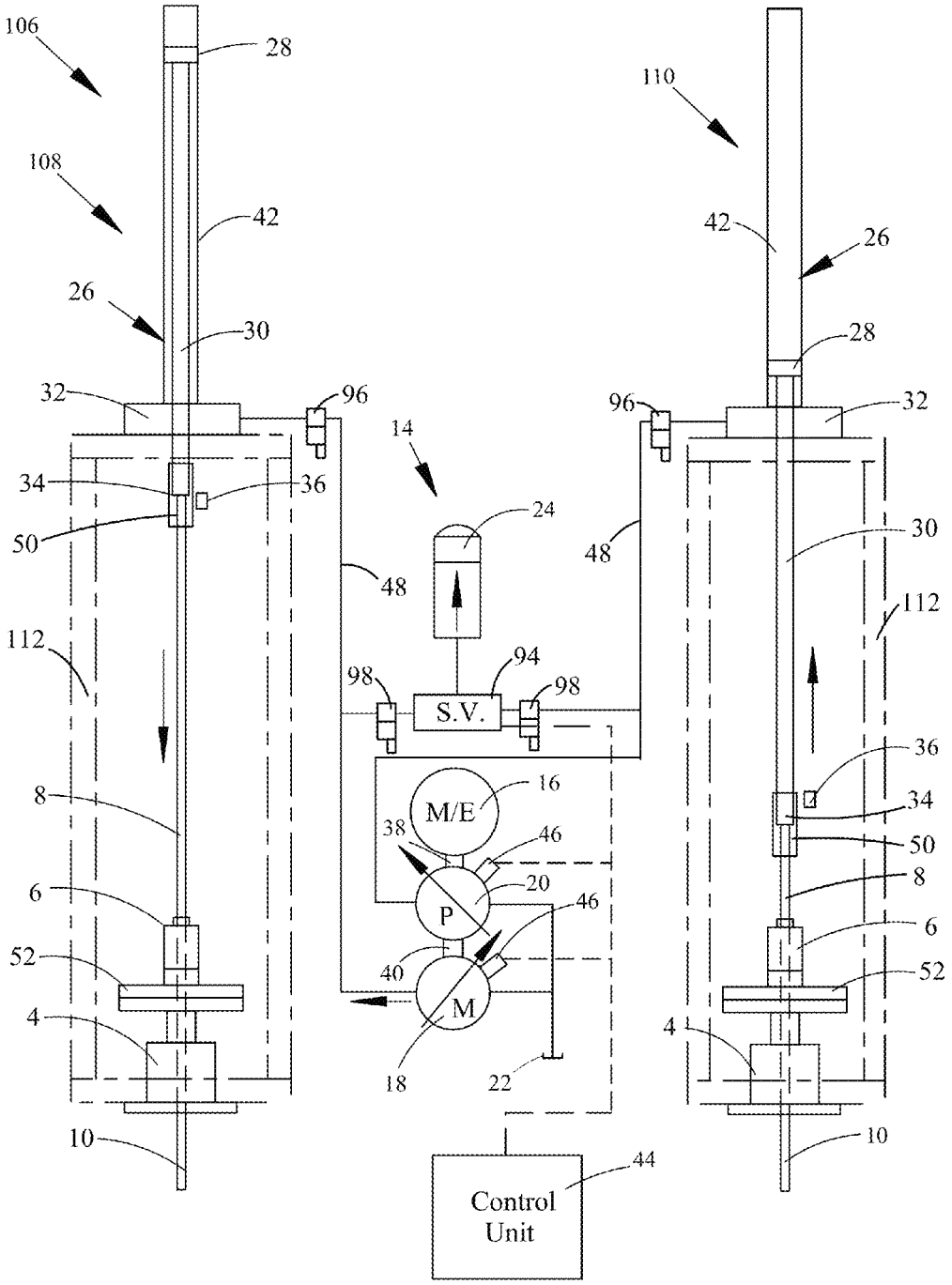
Figure 8:
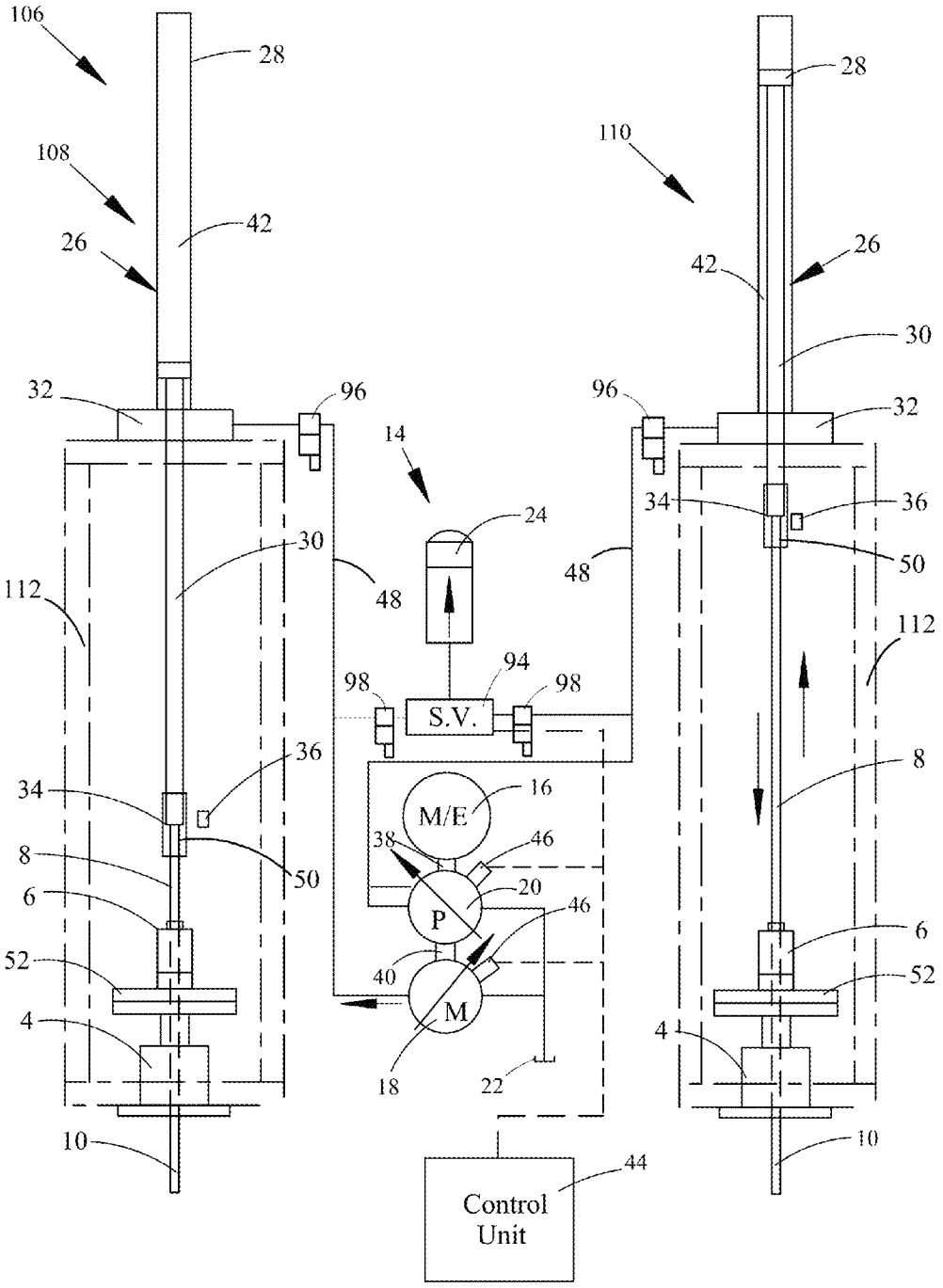

FIGS. 7 and 8 similarly show a dual well regenerative system 106 with two wellhead pumping units 108 and 110 operated by a single hydraulic power unit 14. The wellhead pumping units 108 and 110 have similar components as that of the hydraulic pumping units 102 and 104 of FIGS. 1-6 discussed above, except that rather than providing three rams 26 for each of the ram pumping units 102 and 104, a single hydraulic ram 26 is inverted and mounted atop a support structure 112 for each of the ram pumping units 108 and 110. A single hydraulic power unit 14 of FIGS. 7 and 8 requires only one prime mover for both of the pumping units 108 and 110, and provides regenerative assist between the two pumping units 108 and 110. A hydraulic accumulator 24 is also provided, preferably by a nitrogen charge accumulator, for use when one of the two wells is taken out of service. The shuttle valve 94 connects the high pressure side of the wells 108 and 110 to the accumulator 24. The solenoid valves 98 are also provided on opposite sides of the shuttle valve 94, and may also be used controlling flow between accumulator 24 and the pumping units 108 and 110 in place of the shuttle valve 94. The hydraulic accumulator 24 may also be used to store and provide energy as noted above for FIGS. 1-4, when the regenerated potential energy recovered from one pumping unit on a first well is greater than the energy required to lift the other pumping unit on a second well. Each of the ram pumps 18 and 20 has one of the pump control units 46 integrated with the respective pump housing. A control unit 44 is provided and connected to each of the pump control units 46, position sensors 36 and fluid pressure sensors (not shown).

The pumping units 108 and 110 are synchronized such that one of the pumping units 108 and 110 will be on an up stroke while the other of the pumping units 108 and 110 is on a downstroke. The potential energy of the lifted weight of the sucker rod assembly on the well on the downstroke is recovered and used to provide assist to the other pumping unit on the up stroke. FIG. 7 shows the pumping unit 108 during a downstroke and the pumping unit 110 during an up stroke. The potential energy stored in the lifted the weight on the sucker rod 8 pushes hydraulic fluid from the hydraulic ram 26 of the pumping unit 108 and turns the ram pump 18. The pump 18 is actuated to an over-center condition and acts as a motor for assisting the drive motor 16 in turning the ram pump 20. The ram pump 20 is in a pump configuration for turning to force the hydraulic fluid into the hydraulic ram 26 of the pumping unit 110, lifting the sucker rod 8 of the pumping unit 110. Similarly, FIG. 8 shows the pumping unit 108 during an up stroke the pumping unit 110 during a downstroke. The potential energy stored in the lifted weight on the sucker rod 8 of the pumping unit 110 pushes hydraulic fluid from the hydraulic ram 26 of the pumping unit 110 and turns the pump 20. The pump 20 has been actuated to an over-center condition and acts as a motor for assisting in turning the pump 18 in cooperation with the motor 16. The ram pump 18 has been moved back from the over-center condition to operate as a pump and is turned by the ram pump 20 and the drive motor 16 to force the hydraulic fluid into the hydraulic ram 26 of the pumping unit 108, lifting the sucker rod 8 of the pumping unit 108. The hydraulic accumulator 24 may also be used to store and provide energy as noted above for FIGS. 1-4, when the regenerated potential energy recovered from one pumping unit on a first well is greater than the energy required to lift the other pumping unit on a second well. Thus, a first one of the wellhead pumping units 108 and 110 during a downstroke will counterbalance the second of the wellhead pumping units 108 and 110 during an up stroke, with the first providing regenerative assist to the second in lifting the sucker rods 8.

For a dual regenerative assist an even number of wells is preferably required for proper counterbalance. Although the system can accommodate many wells, it is most practical for four wells since then number of wells increases, the hydraulic power unit gets more complicated, the prime mover size increases, and the distance between wells increases. If the prime mover, or motor, fails or has a problem then all of the wells are shut-down. For example, a cluster with dual well regenerative control with two wells requires that both hydraulic ram pumping units be synchronized so that when one pumping unit is on the up stroke the other pumping unit is on the down stroke. The stored potential energy of the polished rod from the down-stroke well is used to both assist in powering the up stroke of the polished rods in the other well and to provide counter-balance. If one of the wells is shut-down for work-over, a stand-by accumulator can be activated to provide power assist and counter-balance. The prime mover can be an electric motor or gas engine.

This system is preferably used for a cluster of wells which are within 150 ft. (50 m) of each other, and it allows a single hydraulic power unit 14 to operate up to four different wells. Each well will have a wellhead ram pumping unit that connects to the hydraulic power unit with a single hose and control cable. In a four well configuration there will be two master/slave systems; with a separate pump control unit for each well. The only differences between the dual or multiple well hydraulic power units is the number of controls based on number of wells and selector valves for activating the accumulator when one of the wells is shutdown.

The pump control 44 which interfaces with the control units 46 for each of the hydraulic pumps 18 and 20 preferably has individual microprocessors, one for each well unit, with on-site input means, such as touch screens. The speed of both well pumping units is set with one of the pumping units being controlled a master and the other of the control pumping units being controlled as a slave. The master control unit 44 will control the speed at which the slave pumping unit operates, with feedback from the stroke position of ram of the slave wellhead pumping unit. Each well's stroke length, variable speed pump-down, and acceleration or deceleration can be independently adjusted as control provided for each well according to different, independent dynamometer cards. Preferably, the master control unit 44 will receive position feedback information for the position of the pumping unit ram controlled as the slave. The master control unit 44 automatically signals the slave pump control unit to adjusts the displacement of the slave hydraulic pump during the down-stroke to match the downstroke speed of the slave hydraulic pump to the up-stroke speed of master well, even if the stroke length of the wells are different. During downstroke of the master well, the displacement of the master hydraulic pump is adjusted to match the speed of the slave hydraulic pump which is operating over center to act as a motor during an up stroke of the slave ramp pumping unit. This makes sure that both units are synchronized to reverse at the same time to control counter-balance and prime mover loads.

As an example, a 7874 ft. well has a 1.25 inch downhole pump, a Peak Polished Rod Load of 18,543 lbs, and a Minium Polished Rod Load of about 11,654 lbs, or a load differential of 62%. If Well "A" pumping unit requires 50 HP on the up stroke to lift the polished rod, Well "B" pumping unit is on the down stroke and generating 56% (including inefficiency) or 28 HP through a hydraulic motor that assists well "A"s hydraulic pump. The actions are reversed when the pumps (alternating in acting as hydraulic motors) stroke positions are reversed. The amount of regenerative assist depends upon the maximum and the minimum polished rod load differential and the system efficiencies. The wells are preferably close to each other, spaced apart no more than 150 Ft. (50 m) to allow the hydraulic pump assist to function properly. The following are examples of a test well:

| CYLINDER "A" ON UP STROKE | | CYLINDER "B" ON DOWN STROKE | |
|---|---|---|---|
| PRESSURE: | 1968 PSI | PRESSURE: | 1237 PSI |
| FLOW: | 41 GPM | FLOW: | 41 GPM |
| HP: | 50 | REGEN HP: | 28 HP |
| Net Power required: | 22 HP | | |

Prime Mover Required:

25 HP Electric Motor.

30-40 HP @ 1800 RPM Gas Engine (The gas engine should be sized so it does not run fully loaded, this saves fuel and extends engine life.)

Figure 9A:
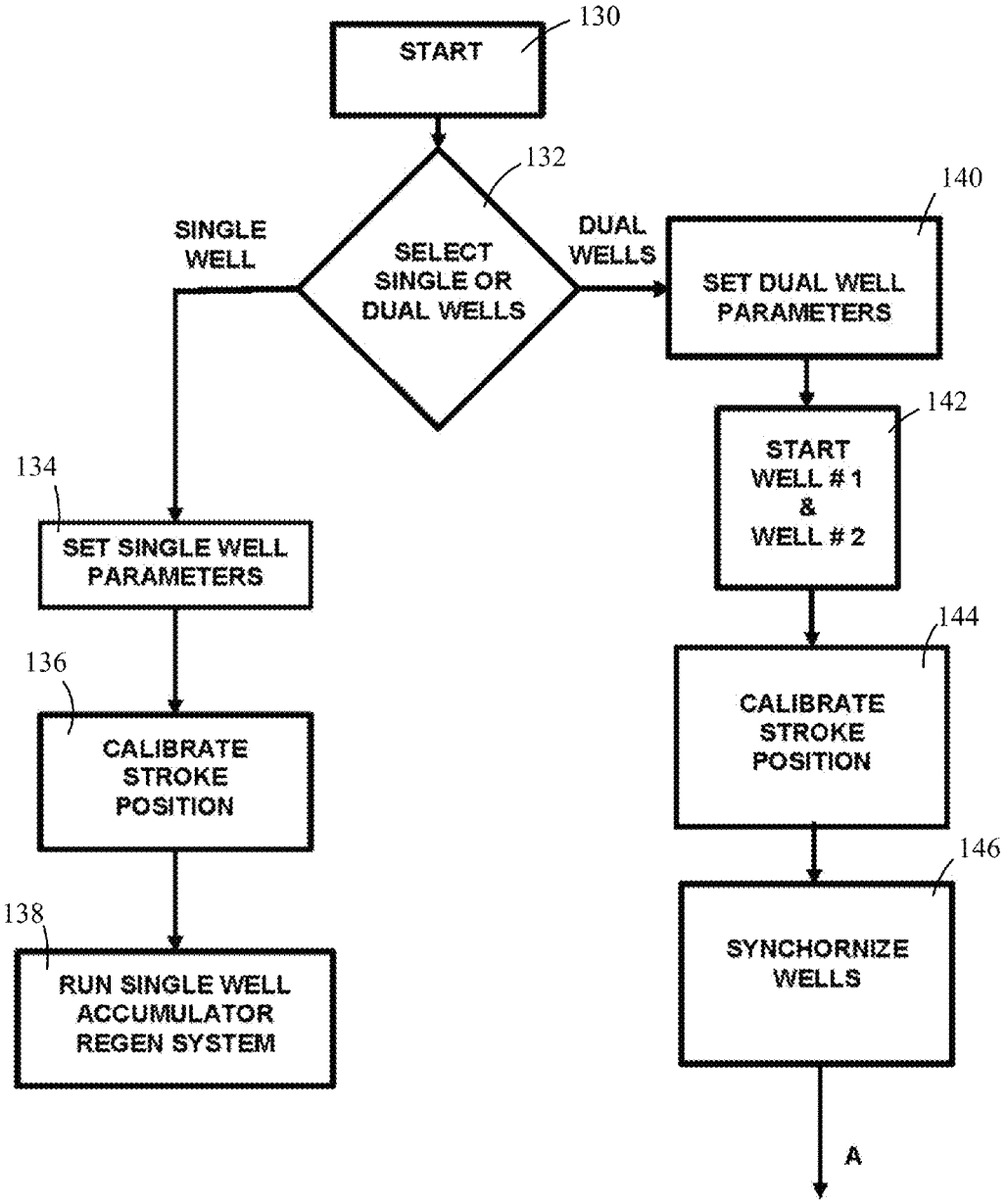
FIGS. 9A and 9B together provide a flow chart for operation of a dual well system with regenerative assist.
Figure 9B:
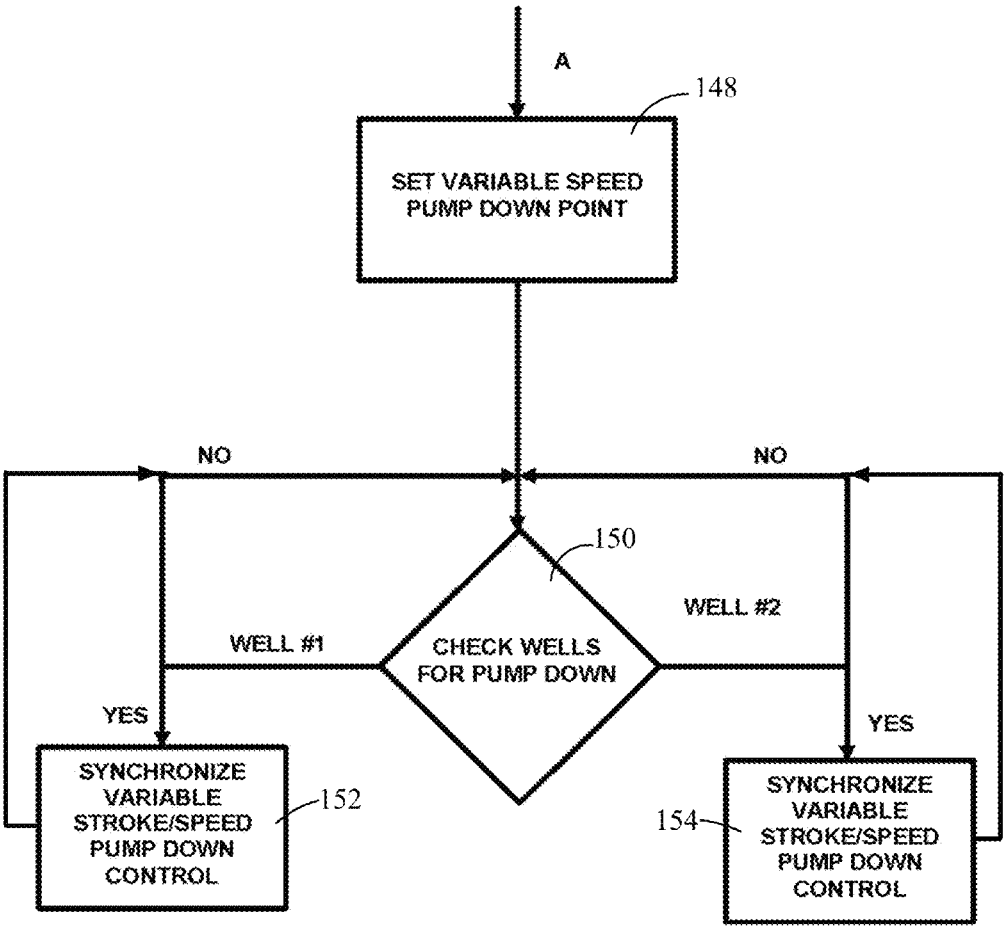

FIGS. 9A and 9B together provide a flow chart for operation of a dual well system with regenerative assist. The process begins with a start step 130 and then proceeds to a decision block depicting a step 132 in which a user selects either a single well operation mode or a dual well operation mode. If the single well operation mode is selected in step 32 the process proceeds to step 134 and single well parameters are set in the controller 44. The system will then proceed to step 136 and the stroke position is calibrated. In step 138 the respective controller 44 will run a single well regenerative system using the accumulator 24 for storing recovered energy during the downstroke and emitting energy for assisting in powering the up stroke, as noted above.

If in step 132 the dual well operation mode is selected, the process proceeds to step 140 and dual well operational parameters are set in the controller 44. In step 142 both of the dual wells 108 and 110 are started. In step 144 the stroke position is calibrated using position sensors 36 and the calculated known volume of the hydraulic fluid passing through the pumps 18 and 20, which are positive displacement pumps. Then, in step 146 the wells are synchronized so that the up stroke of the ram pumping unit for one well occurs during the downstroke of the ram pumping unit for the other well. If a first ram reaches the top of the up stroke, or downstroke, prior to the second ram, the speed of the first ram is slowed as it begins to stroke in the opposite direction until the other ram reaches the end of its stroke, and the speed of the first stroke returns to its original rate as determined by the controller 44 for the pumps. The flow rates of hydraulic fluids through the respective one of the pumps moving a ram during an up stroke is determined by the swash plate angle which provides the displacement of the pump.

In step 148 a pump down point is set for each of the wells, as noted in the pump down discussion set forth below in reference to FIGS. 13-15. The process then proceeds to step 150 and pump down for each of the wells is checked, preferably during each stroke of the wells. If pump down is not detected for either of the wells 1 or 2, the process proceeds to loop an again perform step 150 to check for pump down of both wells. If pump down is detected for one of the wells, the process proceeds to a respective one of the steps 152 and 154 and synchronizes the stroke and the speed of the respective ram for the well which has pumped down. The process will then return back to the step 150 and both wells will be checked for pump down. The process will continue to loop between the steps 150-154 until stopped by an operator.

Figure 10:
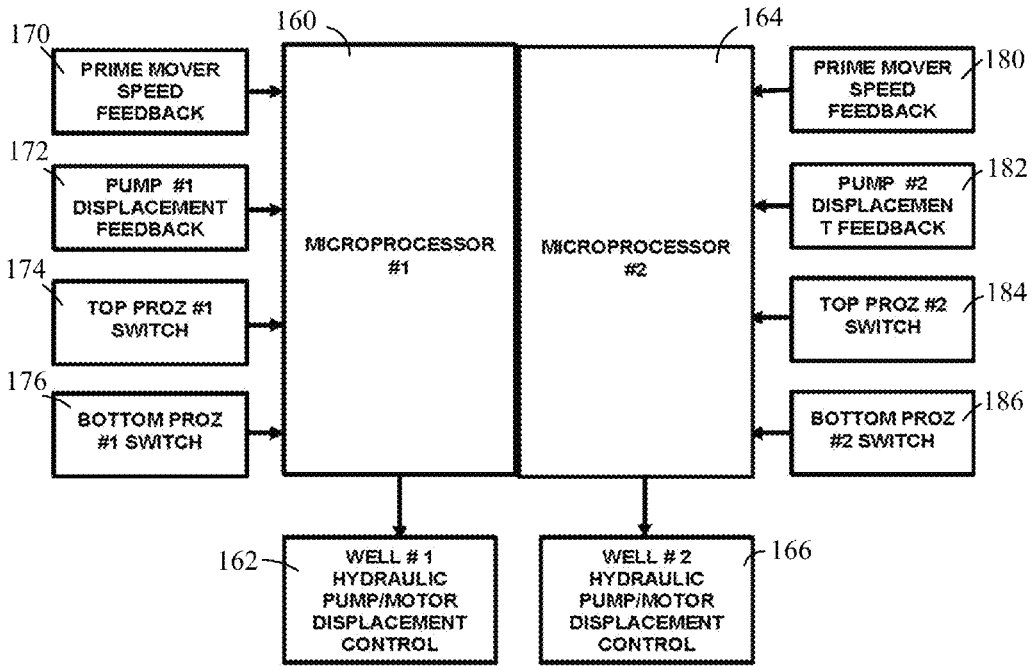

FIG. 10 is a schematic block diagram depicting calibration of stroke position and ram synchronization. A positioning system includes top proximity sensors 174 and 184 and bottom proximity sensors 176 and 186 for each ram pumping unit, for determining when the respective rams are disposed in a selected position during a stroke. Pump sensors 172 and 182 are provided in each of the hydraulic pumps for determining the swash plate angles which provide the displacement for each of the pumps. The swash plates are rotated at known angular velocities, provided by the prime mover rotary speed sensors 170 and 180. Microprocessor controllers 160 and 164 are provided for each pump for calculating positioning of the respective hydraulic ram during a stroke relative to the selected position. The microprocessor controllers 160 and 164 use the stroke position of each ram to determine when one is on the up stroke and one is on the down stroke and controls the pumps displacements to synchronize them so they reverse directions at substantially the same time. Well "1" and Well "2" are synchronized when Well "1" is on the down-stroke, Well "2" is on the up-stroke. The Down Stroke polished rod load on Well "1" forces the ram down pumping the oil back into the hydraulic motor; the microprocessors 160 and 164 control each of the pumps displacement through the displacement controls 162 and 166 for each pump, which controls the respective swash plate angles for each of the pumps which in turn controls the rate of flow of oil from each of the rams for providing counterbalance and the power that assists the prime mover (electric motor or gas engine) and for driving the hydraulic pump that lifts the ram during the up-stroke.

Figure 11:
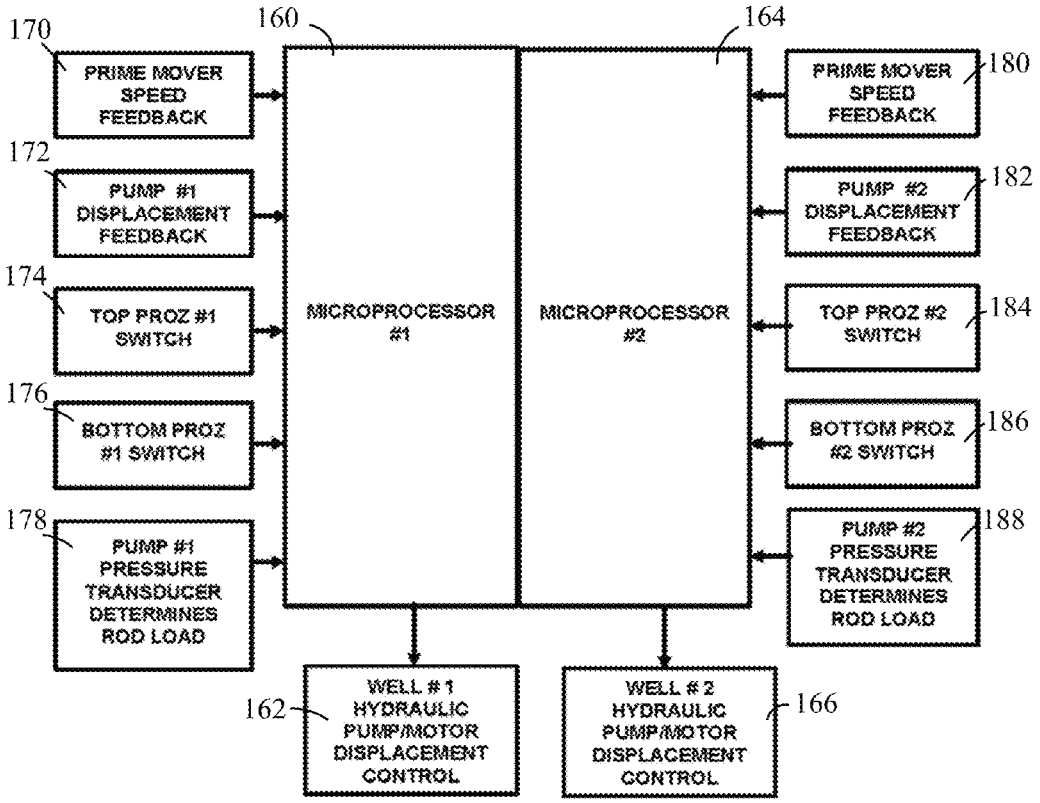

FIG. 11 is a schematic block diagram of variable stroke and speed pump down control for the dual well system. The system discussed above in reference to FIG. 10 is used, with the addition of the input into the microprocessors 160 and 164 of pump pressure transducers 178 and 188 for each respective pump for determining rod load. Pump pressure applied to each of rams can be used in combination with the cross-sectional area of the particular ram to determine the rod load. Rod load from the sensors 178 and 188 is used with position information from proximity switches 174, 176 and 184, 186 to determine when pump down occurs. The microprocessor controller checks each well for Pump Down on every stroke (FIGS. 12-15 for pump down characteristics). The black dot 212 shown in FIG. 12 indicates a rod load and a stroke position target for pump down check. If the rod load stays below this target past the pump off angle, the control takes it as indicating no pump down and increases the stroke length and speed 3% per stroke until it reaches max stroke length and speed setting. If the rod load stays above this target, pump down has occurred and the control reduces the stroke length and speed at the rate of 1.5% per stroke until it reaches the min stroke length setting. The pump down control will increase or decrease the stroke length and speed for each stroke as required to maintain a constant fluid level.

For example, if the microprocessor controller for Well 2 detects a Pump-Down condition, the microprocessor controller will reduce the stroke length and the speed for the ram pumping unit for Well 2 during each stroke until no pump down is detected, and then on the following stroke will increase the stroke length and speed until pump down is again detected. The stroke length and the speed are continuously adjusted to maintain a constant fluid level. To keep the wells synchronized; the microprocessor controller will decrease Well 2 speed the same percentage as it reduced its stroke length to match the period time cycle for Well 1. Stroke Length and Speed will continue to decrease at a rate of 1.5% per stroke or increase at the rate of 3% until a constant fluid level is reached. The other well (Well 1) will continue to run at its preset speed and stroke length until it detects a pumped down condition: at which time it will decrease only its speed and Well 2 will increase its stroke length and speed to maintain a constant fluid level and stay synchronized with Well 1. If Well 1 speed is decreased to the level of Well 2 its stroke length and speed will decrease to stay synchronized with Well 2. The wells will always stay synchronized no matter which well is pumped-down.

Figure 12:
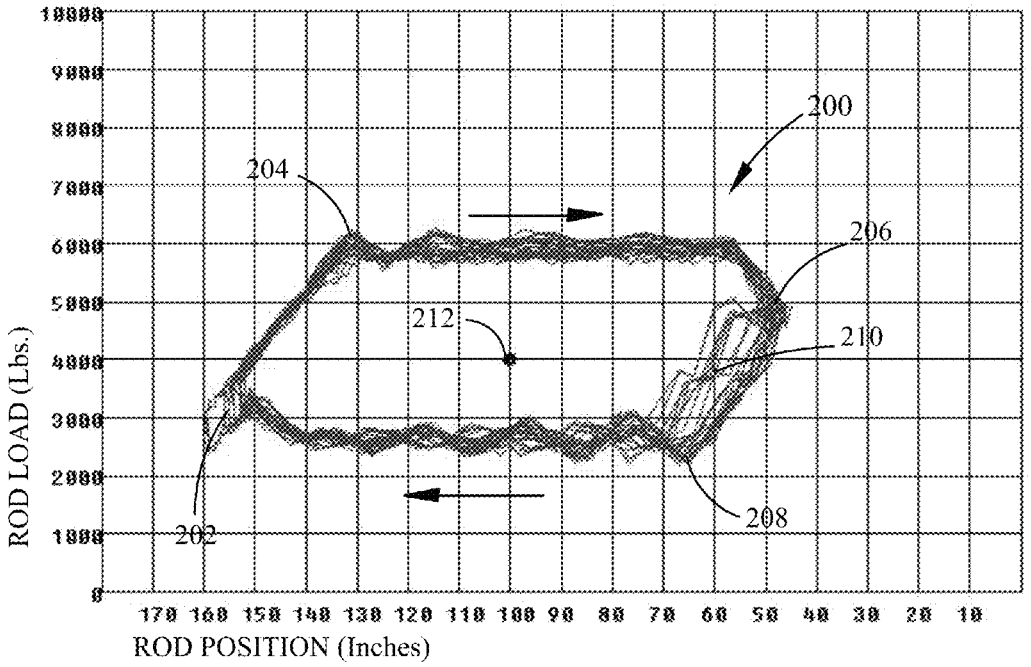

FIG. 12 is a pump card illustrating pump down control, showing a plot 200 of rod load in pounds verses rod position in inches. The up stroke of the pump is represented as the upper portion of the plot 200, running from point 202 at which the traveling valve closes, through point 204 at which the standing valve opens, and then to point 206 at which the standing valve closes. The downstroke is represented by the lower portion of the plot 200, running from the point 206, through point 208 at which the traveling valve opens, and then returning to the point 202 at which the traveling valve closes. The right side portion 210 of the plot 200 represents changes in the rod load which are encountered when pump off occurs. The rod load will remain at a larger weight until the traveling valve encounters the fluid level in the pump chamber, and then the rod load will decrease after entering fluid beneath the level of fluid in the pump chamber. The pump-off point 212 represents a point on the plot 200 which is selected as the point to reduce the speed of the pump to allow the fluid level to increase in the downhole pump chamber. The pump-off point 212 is detected when for a particular rod position the rod load is above a rod load at which the traveling valve is submerged.

Figure 13:
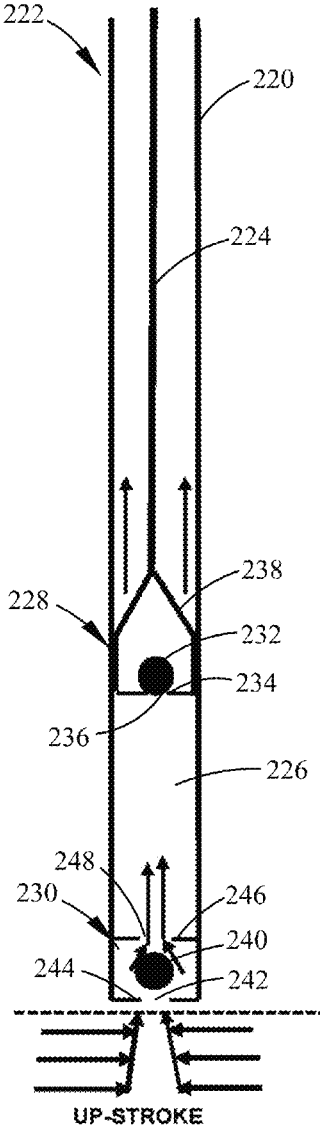
Figure 14:
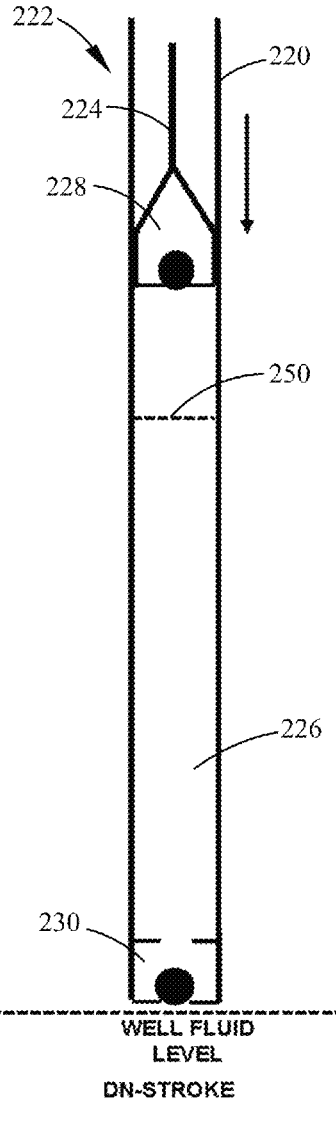
Figure 15:
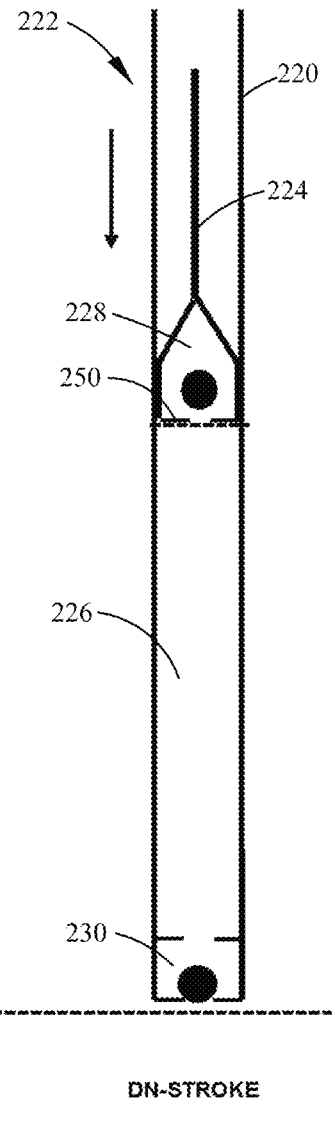

FIGS. 13-15 illustrate a downhole pump 222 suspended on tubing 220 and powered by sucker rods 224. The pump 222 has a pump chamber 226, a traveling 228 and a standing valve 230. The traveling valve 228 has a ball 232, a ball seat 234 and a flow port 236 which passes through the ball seat 234. The ball 232 will engage the ball seat 234 to seal the flow port 236. Flow ports 238 are provide in the upper portion of the traveling valve 228 for passing fluid which passes through the flow port 236. Similarly, the standing valve 230 has a ball 240, a ball seat 242 and a flow port 244 which passes through the ball seat 242. The ball 240 will engage the ball seat 242 to seal the flow port 244. Flow ports 248 are provide in the upper portion of the standing valve 230 for passing fluid which passes through the flow port 244.

FIG. 13 shows an up stroke and FIGS. 14 and 15 show a downstroke for the pump 222. FIG. 13 show that during the up stroke, the rods 224 lift the traveling valve 228 and the weight of the fluid on top of the traveling valve 228 will seat the ball 234 on the ball seat 236, closing the traveling valve 228. In the standing valve 230 the ball 240 will lift off the seat 242, opening the standing valve 230 and well fluids will flow into the pump chamber 236. FIGS. 14 and 15 shows that during the downstroke the traveling valve 228 will remain closed until the liquid level is encountered, at which time the traveling valve 228 will open and the standing valve 230 will be held closed by the traveling valve 228 moving toward the standing valve 230. Well fluids in the pump chamber 226 will pass through the traveling valve 228. The cycle will then repeat with the traveling valve 228 moving upward to lift the well fluids which are located above the traveling valve 228, and the standing valve 230 will again open to pass well fluids into the pump chamber 226. During the up stroke the pump 222 lifts the fluid that has entered the pump chamber 226 through the standing valve 230 on the previous up stroke, and fluid from the formation enters the pump barrel when the standing valve 230 opens.

During the up stroke the traveling valve 228 in the pump plunger closes and the fluid column weight is now on the sucker rods 224 as the fluid is lifted to the surface. The up stroke sucker rod load is the weight of the sucker rod string 224 and the weight of the fluid column being lifted by the traveling valve 238. During the down stroke the traveling valve 228 will open when it contacts the fluid in the pump barrel 226 and the fluid column weight will transfer from the rod string 224 to the tubing 220. If the pump barrel 226 did not fill completely during the up stroke the rod load will remain high until the traveling valve 228 reaches the pump fluid level 250, at which time the traveling valve 228 will open and the fluid column weight will be removed from the sucker rods 224, as shown in FIG. 15. Pump down can be detected by measuring the rod weight at the surface and the position of the pump stroke. A load transducer and stroke position system measures the distance from the top of the stroke to when the rod load changes as the traveling valve 228 opens, this is the pump down point 212 shown in FIG. 12, which is used to determine when pump down has occurred to a point which should then be corrected by adjusting the rate at which fluid is being pumped from the well.

For Dual Well regenerative operation, two wells are being synchronized to for recovering the downstroke energy of one well to assist in powering the up stroke for the other well. Should Well 2 pump-down, then the controller for Well 1 will continue to operate Well 1 at maximum speed and maximum stroke length until a pump down condition is detected. In response to detecting pump down in Well 2, the speed and the stroke length of Well 2 are decreased by the same percentage so that Well 2 will remain synchronized with Well 1. Similarly, should Well 1 pump-down, then in response to detecting pump down the speed and the stroke length of Well 1 are decreased by the same percentage so that Well 1 will remain synchronized with Well 2. When pump down is not detected for either Well 1 or Well 2, then the speed and the stroke length for that respective well are increased by the same percentage, up to maximum values, to remain synchronized with the other well. The Well 1 and Well 2 will always stay synchronized, starting and ending their cycles substantially together, no matter which well is pumped-down.

In maintaining a constant fluid level in the pump barrel, also referred to as the pump chamber, preferably during pump down detection of a well its Stroke Length and Speed will be decreased at a rate of 1.5% per stroke. When pump down is not detected, the Stroke Length and Speed are increased at the rate of 3.0% per stroke until pump down is detected. In other embodiments, the stroke lengths remain constant and the wells remain synchronized by slowing the speed of the non-pumped down well at the bottom of the up stroke until the pumped down well finishes the downstroke and begins its up stroke.

An example of pump down control is shown in Tables A, B and C which list calculated net power requirements with dual well regenerative assist between Well 1 and Well 2, with Well 2 shown in a various pump down conditions. When pump down is encountered in one of the dual wells, the corresponding pump controller will reduce both the speed and the stroke length of a ram unit for the pumped-down well by the same percentage, to maintain a constant cycle time between up strokes and then down strokes such that the ram unit of the pumped down well will remain synchronized with a ram unit of the other well. Preferably the speed and the stroke length of the ram unit of the pumped down well will be decreased by 1.5% per stroke when pump down is detected, and will be increased, for this embodiment, by 3% per stroke until a constant fluid level is reached. The constant percentage change for the velocity and the stroke length will keep the period for an up stroke and a downstroke constant so that the two wells remain synchronized.

Well 1 and Well 2 are preferably synchronized to operate at the same number of cycles or number of strokes per minute, with the up stroke of one well occurring during the downstroke of the other well. Well 1 and Well 2 also have the following operational parameters:

Operating Speed: 3 Strokes per Minute (spm)

Maximum Stroke Length: 168 inches (14 feet)

Peak Polished Rod Load: 20,000 Lbs. (Up Stroke)

Minimum Polished Rod Load: 10,000 Lbs. (Downstroke)

TABLE A

| NET POWER REQUIRED DURING WELL NO. 1 UP STROKE | | | | | |
|---|---|---|---|---|---|
| PUMP DOWN REDUCTION (Stroke Length and Velocity) | WELL No. 2 STROKE LENGTH (Inches) | WELL No. 2 ROD VELOCITY (Feet/Min) | WELL No. 1 UP STROKE POWER REQ. (HP) | WELL No. 2 DOWNSTROKE POWER ASSIST (HP) | WELL No. 1 NET POWER REQUIRED (HP) |
| 0% | 168 | 84 | 53.5 | 26.8 | 26.7 |
| 20% | 134 | 67 | 53.5 | 21.3 | 32.2 |
| 40% | 100 | 50 | 53.5 | 16 | 37.5 |
| 50% | 84 | 42 | 53.5 | 13.4 | 40.1 |
| 70% | 50.4 | 25.2 | 53.5 | 8 | 45.5 |

TABLE B

| NET POWER REQUIRED DURING WELL NO. 2 UP STROKE | | | | | |
|---|---|---|---|---|---|
| PUMP DOWN STROKE & VELOCITY REDUCTION | WELL No. 2 STROKE LENGTH (Inches) | WELL No. 2 ROD VELOCITY (Feet/Min) | WELL No. 2 UP STROKE POWER REQ. (HP) | WELL No. 1 DOWNSTROKE POWER Assist (HP) | WELL NO. 2 NET POWER REQUIRED (HP) |
| 0% | 168 | 84 | 53.5 | 26.8 | 26.7 |
| 20% | 134 | 67 | 42.7 | 26.8 | 15.9 |
| 40% | 100 | 50 | 31.9 | 26.8 | 5.1 |
| 50% | 84 | 42 | 26.8 | 26.8 | 0 |
| 70% | 50.4 | 25.2 | 16 | 26.8 | −10.8 |

TABLE C

| TOTAL NET MOTOR POWER REQUIRED (FULL CYCLE) | | | |
|---|---|---|---|
| PUMP DOWN STROKE & VELOCITY REDUCTION | WELL No. 1 UP STROKE NET POWER (HP (kW)) | WELL No. 2 UP STROKE NET POWER (HP (kW)) | MAXIMUM MOTOR POWER REQUIRED (HP (kW)) |
| 0% | 26.7 | 26.7 | 26.7 |
| 20% | 32.2 | 15.9 | 32.2 |
| 40% | 37.5 | 5.1 | 37.4 |
| 50% | 40.1 | 0 | 40.1 |
| 70% | 45.5 | −10.8 | 45.5 |

Without pump down requirements, the dual well regenerative assist would reduce in half the size of the motor required for a single well, from 53.5 horsepower (39.9 kW) motor to 26.7 horsepower (19.9 kW). However, with pump down requiring a reduction in stroke length and corresponding reduction in polished rod velocity to keep the cycle time consistent, to thereby synchronize the pumping units of the two wells, as shown above, a 45.4 horsepower (33.9 kW) rated motor is required, still allowing for a 15% reduction in the rating for the motor used for powering the dual well regenerative assist configuration.

For the first example of well data shown in the first rows of Tables A, B and C, pump down has not been detected and the stroke length and velocity of the ram pumping unit for Well 2 has not been reduced. At a stroke length of 168 inches and an operating speed of 3 strokes per minute, the rod velocity for Well 2 will be 84 fpm. Table A shows that during an up stroke of Well 1, 53.5 hp is required for lifting the ram for Well 1, during which the downstroke of Well 2 will provide a power assist of 26.7 hp. This will provide a net power requirement of 26.7 hp. Table B shows that during an up stroke of Well. 2, 53.5 hp is required for lifting the ram for Well 2, during which the downstroke of Well 1 will provide a power assist of 26.8 hp. This will provide a net power requirement of 26.7 hp. The larger of the net horsepower is the same for both wells, 26.7 hp, which will be the minimum power requirement for the motor 16 without a reduction in the speed and the stroke length for the ram pump of Well 2.

In the second example of well data shown in the second rows of Tables A, B and C, the Pump-Down Control for Well 2 has detected a pump-down condition and has reduced the stroke length and speed for Well 2 to maintain a constant fluid level. To keep the wells synchronized, the speed of Well 2. has been decreased the same percentage as the polished rod stroke length. For Well 2 the Stroke Length and polished rod velocity will continue to decrease at a rate of 1.5% per stroke and increase at the rate of 3.0% until a constant fluid level is reached. In this example, the stroke length and the velocity of the ram pumping unit for Well 2 has been reduced by approximately 20 percent, which maintains the period for the cycle time for Well 2 to maintain synchronization will Well 1. Table A shows that during an up stroke of Well 1, 53.5 hp is required for lifting the ram for Well 1, during which the downstroke of Well 2 will provide a power assist of 21.3 hp. This will provide a net power requirement of 32.2 hp. Table B shows that during an up stroke of Well 2, 42.7 hp is required for lifting the ram for Well 2, during which the downstroke Well 1 will provide a power assist of 26.8 hp. This will provide a net power requirement of 15.9 hp. Table C shows the larger of the net horsepower between Table 1 and Table 2 for the 20% reduction in the speed is 32.2 hp, which will be the minimum power requirement for the motor 16 at the 20% reduction in speed and stroke length for the ram pump for Well 2.

In the third example of well data shown in the third rows of Tables A, B and C, pump down has been detected and the stroke length and velocity of the ram pumping unit for Well 2 has been reduced by approximately 40 percent, which maintains the period for the cycle time for Well 2 to maintain synchronization will Well 1. Table A shows that during an up stroke of Well 1, 53.5 hp is required for lifting the ram for Well 1, during which the downstroke of Well 2 will provide a power assist of 16 hp. This will provide a net power requirement of 37.5 hp. Table B shows that during an up stroke of Well 2, 31.9 hp is required for lifting the ram for Well 2, during which the downstroke Well 1 will provide a power assist of 26.8 hp. This will provide a net power requirement of 5.1 hp. Table C shows the larger of the net horsepower between Table A and Table B for the 20% reduction in the speed is 37.5 hp, which will be the minimum power requirement for the motor 16 at the 40% reduction in speed and stroke length for the ram pump for Well 2.

In the fourth example of well data shown in the fourth rows of Tables A, B and C, pump down has been detected and the stroke length and velocity of the ram pumping unit for Well 2 has been reduced by approximately 50 percent, which maintains the period for the cycle time for Well 2 to maintain synchronization will Well 1. Table A shows that during an up stroke of Well 1, 53.5 hp is required for lifting the ram for Well 1, during which the downstroke of Well 2 will provide a power assist of 13.4 hp. This will provide a net power requirement of 40.1 hp. Table B shows that during an up stroke of Well 2, 26.8 hp is required for lifting the ram for Well 2, during which the downstroke of Well 1 will provide a power assist of 26.8 hp. This will provide a net power requirement of 0 hp. Table C shows the larger of the net horsepower between Table A and Table B for the 50% reduction in the speed is 40.1 hp, which will be the minimum power requirement for the motor 16 at the 50% reduction in speed and stroke length for the ram pump for Well 2.

In the fifth example of well data shown in the first rows of Tables A, B and C, pump down has been detected and the stroke length and velocity of the ram pumping unit for Well 2 has been reduced by approximately 70 percent, which maintains the period for the cycle time for Well 2 to maintain synchronization will Well 1. Table A shows that during an up stroke of Well 1, 53.5 hp is required for lifting the ram for Well 1, during which the downstroke of Well 2 will provide a power assist of 8 hp. This will provide a net power requirement of 45.5 hp. Table B shows that during an up stroke of Well 2, 16 hp is required for lifting the ram for Well 2, during which the downstroke Well 1 will provide a power assist of 26.8 hp. This will provide a net power requirement of −10.8 hp, which will not be recovered. Table C shows the larger of the net horsepower between Table A and Table B for the 70% reduction in the speed is 45.5 hp, which will be the minimum power requirement for the motor 16 at the 70% reduction in speed and stroke length for the ram pump for Well 2.

Figure 16:
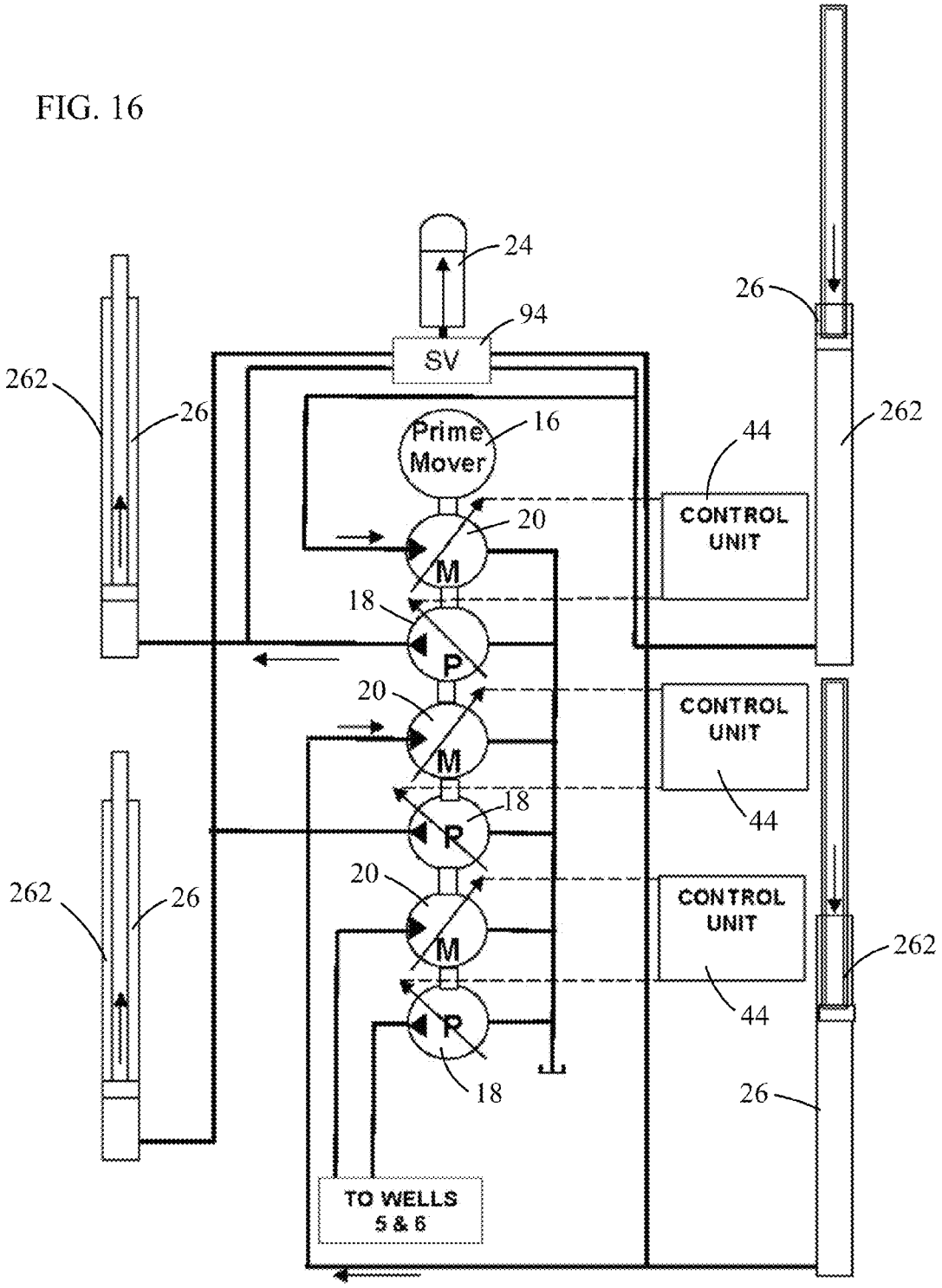

FIG. 16 illustrates a multiple well system with regenerative assist power by a single prime mover 16. Six hydraulic ram pumping units 262 (three pair) are shown being operated by the single prime mover 16 for pumping fluids form six different wells. The prime mover 16 will typically be a gas engine or an electric motor. Control units 44 are provided for operating each of first pumps 18 and second pumps 20, each pair of the pumps 16 and 20 corresponding to powering a pair of the hydraulic ram pumping units 262. Each of the pumping units 262 has at least one hydraulic ram 26, such as that shown in FIGS. 5 and 6 and FIGS. 7 and 8. The ram pumping units 262 are paired. If one of the ram pumping units 262 is taken out of service, then the accumulator 24 is provided for allowing the working ram pumping unit 262 of a pair to continue with the non-working ram pumping unit 262 of the pair remaining out of service. The shuttle valve 94 is connected to the high pressure side of each respective pair of the pumping units 262 and to the accumulator 24. More wells than six may be added, preferably in pairs or an additional accumulator is required for mating with a single well if a single well is added to the singular prime mover 16. The controllers 44 will also preferably provide pump down control, changing the stroke length and the stroke rate by the same percentage for a well being pumped down so that it remains synchronized with a paired well to end and begins each stroke simultaneously with the paired well.

Figure 17:
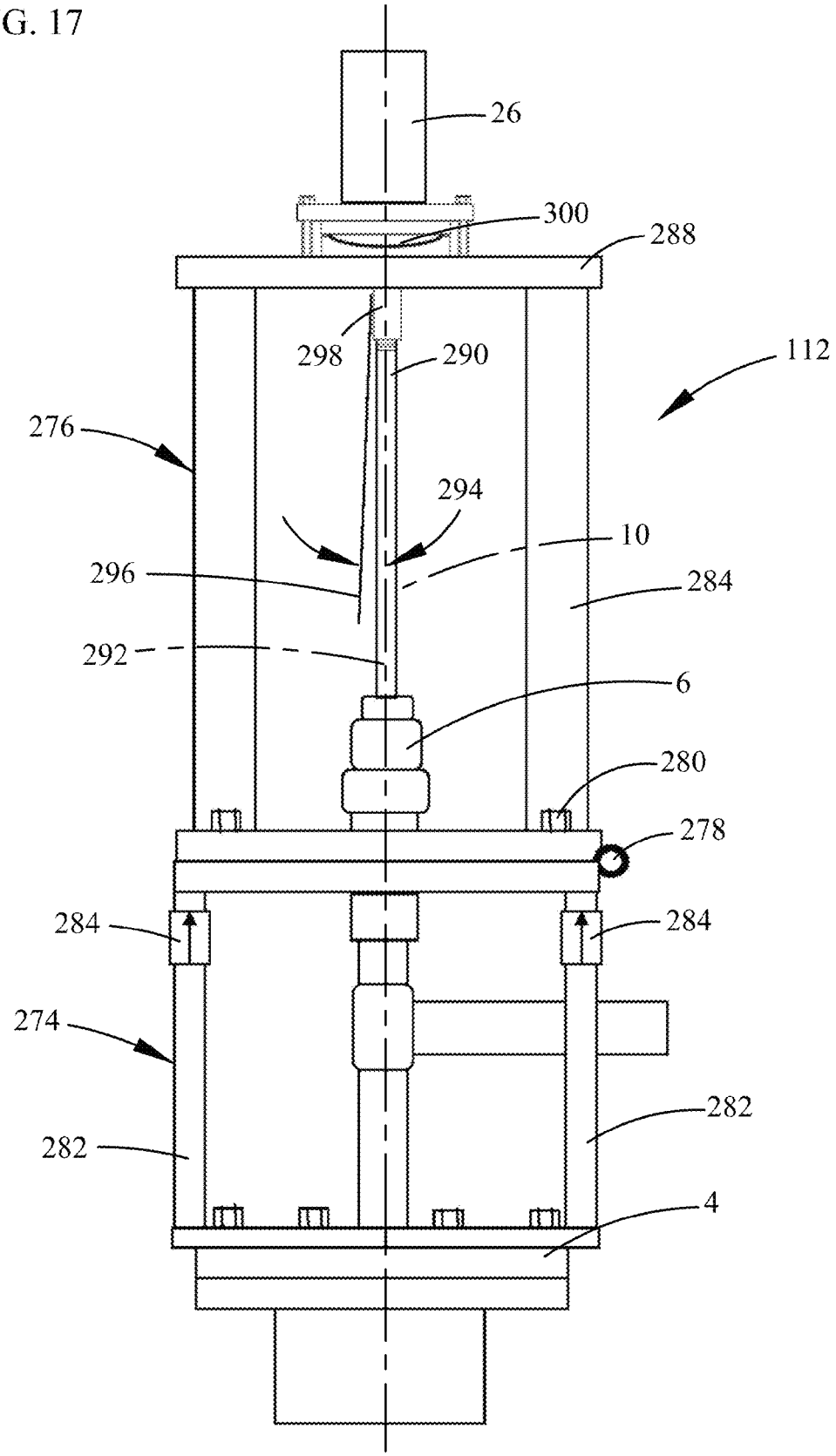
Figure 18:
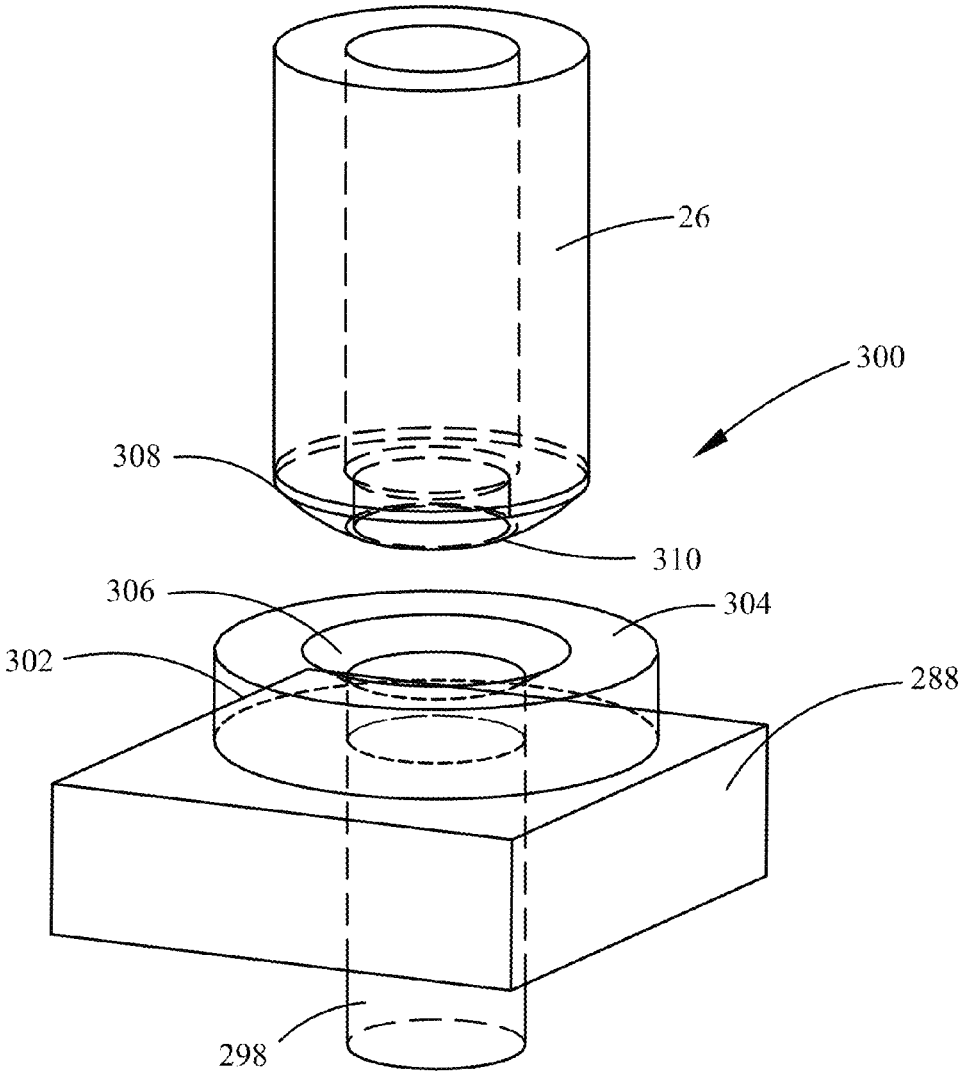
Figure 19:
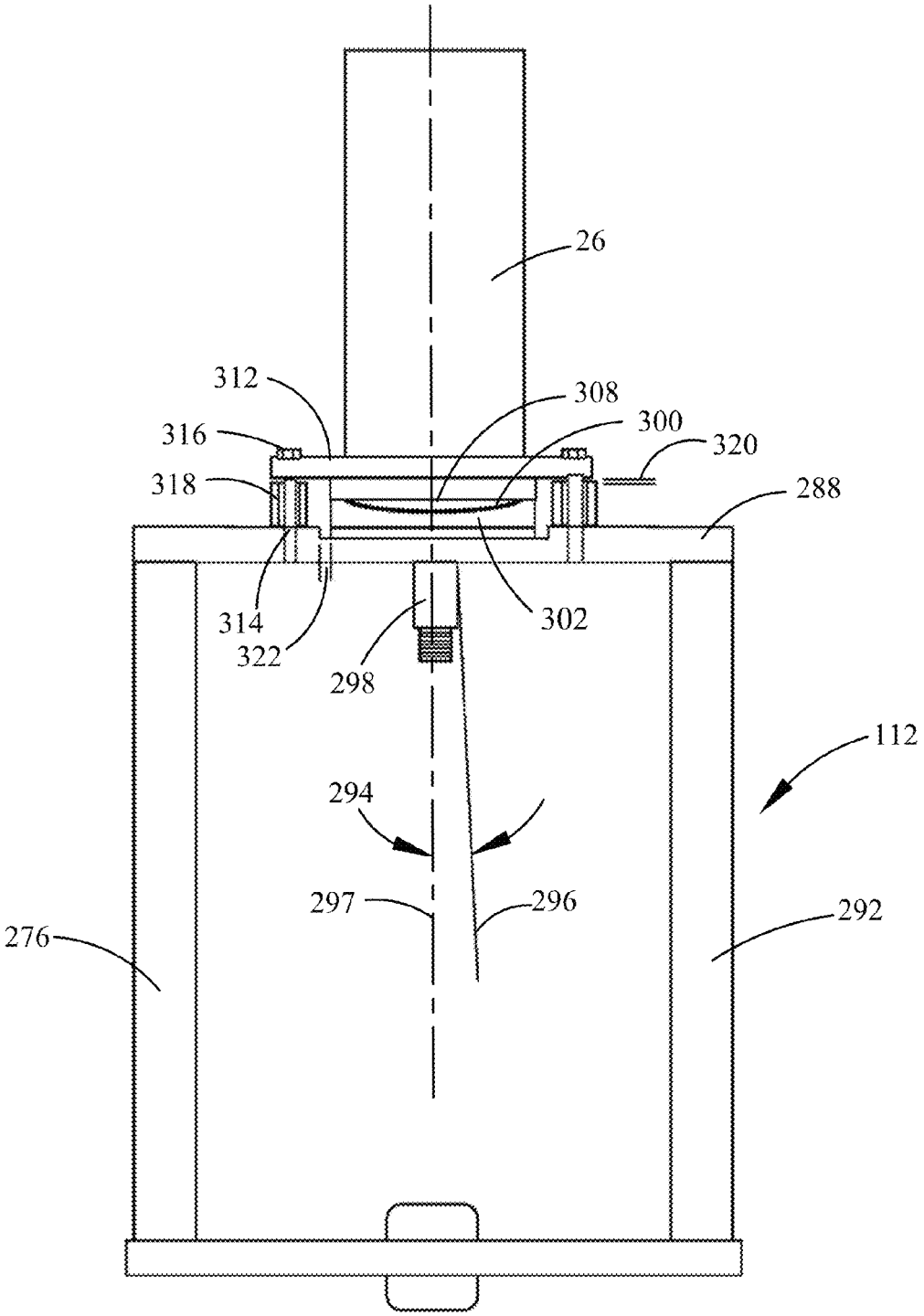

FIGS. 17-19 show details of the support structure 112 of FIGS. 7 and 8 for mounting the hydraulic ram 26 atop the ram pumping unit 108. The structure 112 is provided with self-aligning features so that the hydraulic ram 26 will align with weight applied by the sucker rods 10. The structure 112 includes a base 274 and an upper portion 276 which are pivotally connected together at a hinge 278. Fasteners 280 secure the upper portion 276 in relation to the base 274. The base 274 has legs 282 which are telescopically adjustable in length by means of turnbuckles which include threaded coupling collars 284. Upper and lower portions of the legs 282 have external threads which are configured as threads of opposite hand, respectively, and opposite ends of the coupling collars 284 also have threads of opposite hand for mating with corresponding external threads on the legs 282, such that the upper and lower portions are moved further apart or closer together depending upon the direction of rotation of the threaded couplings 284 around longitudinal centerlines of the legs 282. Adjustment of the lengths of the legs 282 allow for rough alignment of the upper portion 276 relative to the wellhead 4. The upper portion 276 has a mounting plate 288 to which the hydraulic ram 26 is mounted. The hydraulic ram 26 is mounted atop the mounting plate 288 and connected to the sucker rods 10 which extend through the tubing nipple 298, the tubing 290 and into the stuffing box 6. A spherical mounting configuration 300 is provided to allow the ram 26 to align with a centerline 292 of the tubing 290, the stuffing box 6 and the wellhead 4. A projection 296 of longitudinal centerline 296 of the ram 26 can move an angle 294 of approximately two degrees radially, so that the ram will align with the sucker rods 10 when the weight of the sucker rods 10 pull downward on the ram 26.

FIG. 18 shows the spherical mounting configuration 300. A dished ring 302 is mounted to the top of the mounting plate 288 with a dished face 304 facing upwards. The dished face 304 has a recess 306 which preferably has a concave, spherically shaped profile which tapers in a downward direction. A spherical shaped ring 308 is mounted to the lower end of the hydraulic ram 26. The ring 308 has a lower face 310 which is conically shaped to define a convex, rounded surface which tapers in a downward direction. The rounded surface defined by the lower face 310 of the ring 308 will preferably fit flush against the rounded surface of the recess 306 in the ring 302 in a sliding engagement, which allows the ram 26 to pivot along the configuration 300 to align in the direction of the load applied by the sucker rods 10. This will align the rod 30 and the cylinder 42 of the ram 26 with the direction in which the weight of the sucker rods pulls downward, which prevents seal wear for the ram 26 and friction which provides for more efficient operation of the ram 26.

FIG. 19 shows the hydraulic ram 26 mounted atop the upper portion 276 of the support structure 112 to allow sliding movement between the spherical ring 308 and the dished ring 302. The dished ring 302 is preferably fits in a recess 322 which extends into an upper surface of the mounting plate 288. A radial clearance 322 of 0.125 inches is preferably provided between the dished ring 302 and the mounting plate 288, across the recess 322. The radial clearance 322 preferably extends fully around the sides of the dished ring 302. The spherical ring 308 is preferably mounted in fixed relation to the ram 26 and the flange 312. Fasteners 314 extend through holes in the mounting plate 288 and the flange 312 and have ends secured by nuts 316. Sleeves 318 are mounted around the fasteners 314, with ends disposed between the mounting plate 288 and the flange 312. A clearance 320 of approximately 0.080 inches is provided between the upper ends of the sleeves 318 and the bottom side of the flange 312. The clearances 320 and 322 provide an angle 294 of approximately two degrees for radial, pivotal movement of the centerline 296 of the ram 26 relative to the centerline 297 of the rods 10 and the tubing 290.

A dual well hydraulic rod pumping unit has regenerative assist and synchronized variable stroke and variable speed pump down. Should pump down be encountered in one of the wells, the controllers reduce the speed and stroke of the ram for pumped-down well by the same percentage, such that ram unit the pumped down well will remain synchronized with the ram unit other well. Preferably the speed and stroke of the ram of the pumped down well will be decreased by 1.5% per stroke when pump down is detected, and will be increased by 3% per stroke until a constant fluid level is reached. The dual well regenerative system is preferably provided for wells in pairs, such as two wells, four wells, six wells, etc., in a cluster, and synchronizes a pair of wells so when one is on the up stroke the other one is on the down stroke. The down-stroke polished rod energy from the down-stroke of one well is used to assist the other well during its up-stroke and provide counter-balance. If one of the pair of wells is shut-down for work-over, a stand-by accumulator can be activated to provide power assist and counter-balance. A self-aligning mounting configuration is provided for mounting a hydraulic ram for a pumping unit to a support structure using a conical ring which fits into a dished ring.

Although the preferred embodiment has been described in detail, it should be understood that various changes, substitutions and alterations can be made therein without departing from the spirit and scope of the invention as defined by the appended claims.

What is claimed is:

1. A dual well hydraulic pumping unit for removing well fluids from a first well and a second well, comprising:

at least one prime mover;

a reservoir for a hydraulic fluid;

a first sucker rod assembly disposed in the first well for removing the well fluids from the first well;

a first ram connected to said first sucker rod assembly for moving in an upstroke and moving said first sucker rod assembly from a downward position to an upward position, and moving in a downstroke with said first sucker rod assembly moving from said upward position to said downward position;

a second sucker rod assembly disposed in the second well for removing the well fluids from the second well;

a second ram connected to said second sucker rod assembly for moving in an upstroke and moving said second sucker rod assembly from a lowered position to a raised position, and moving in a downstroke with said second sucker rod assembly moving from said raised position to said lowered position;

a first ram pump having a first ram pump suction port connected to said reservoir and a first ram pump discharge port connected to said first ram for transferring the hydraulic fluid into said first ram and moving said first ram from said downward position to said upward position during the upstroke of said first ram;

a second ram pump having a second ram pump suction port connected to said reservoir and a second ram pump discharge port connected to said second ram for transferring the hydraulic fluid into said second ram and moving said second ram from said lowered position to said raised position during the upstroke of said second ram; and at least one control unit configured for controlling flow rates of the hydraulic fluid through said first ram pump and said second ram pump; wherein said at least one control unit operates said first ram pump for pumping the hydraulic fluid into said first ram during the upstroke of said first ram and the downstroke of said second ram, and during the downstroke of said first ram the hydraulic fluid discharged from said first ram cooperating with said at least one prime mover to power said second ram pump in response to pressures within said first ram provided by the weight of said first sucker rod assembly;

wherein said at least one control unit further operates said second ram pump for pumping the hydraulic fluid into said second ram during the downstroke of said first ram and the upstroke of said second ram, and during the downstroke of said second ram the hydraulic fluid discharged from said second ram cooperating with said at least one prime mover to power said first ram pump in response to pressure within said second ram provided by the weight of said second sucker rod assembly in combination; and wherein should pump down be encountered in one of the first and second wells, defining a pumped down well, said at least one control unit will provide pump down control by changing at least one of a stroke length and a stroke rate of the pumped down well and synchronizing the pumped down well and the other of the first and second wells such that they have substantially the same period time cycle, such that the pumped down well and the other well reverse directions at approximately the same time.

2. The dual well hydraulic pumping unit according to claim 1, wherein during pump down conditions, the pumped down well and the other well are synchronized to have the same period time cycle when the stroke rate of the pumped down well is reduced by slowing a stroke rate of the other well proximate to when direction is reversed.

3. The dual well hydraulic pumping unit according to claim 2, wherein during pump down conditions, the stroke rate of the other well is slowed down at the beginning of its next stroke until the pumped down well finishes its current stroke and begins its subsequent stroke.

4. The dual well hydraulic pumping unit according to claim 1, wherein during pump down conditions, the pumped down well and the other well are synchronized to have the same period time cycle by changing the stroke length and the stroke rate of the pumped down well by the same percentage such that the pumped down well period cycle time remains constant.

5. The dual well hydraulic pumping unit according to claim 4, wherein during pump down conditions, the pumped down well and the other well reverse directions at the same time, such that the upstroke of the first well begins simultaneously with the downstroke of the second well.

6. The dual well hydraulic pumping unit according to claim 4, wherein the at least one control unit operates both the first well and the second well to independently determine when pump down conditions are encountered for each of the first and second wells, and then separately for each of the first well and the second well adjusts the stroke rate and the stroke length of the respective first and second wells according to the determination of whether pump down conditions are being encountered.

7. The dual well hydraulic pumping unit according to claim 6, wherein the at least one control unit, separately and independently for each of the first well and the second well, decreases the stroke length and the stroke rate by 1.5% per stroke when pump down is detected and increases by 3% per stroke when pump down is not detected until a constant fluid level is reached.

8. The dual well hydraulic pumping unit according to claim 1, wherein said first ram pump and said second ram pump each further comprise:

a pump housing;

a drive shaft rotatably mounted in said pump housing;

a cylinder block mounted to said drive shaft for rotating with said drive shaft, said cylinder block having a plurality of cylinders formed therein, and a plurality of flow ports in fluid communication with respective ones of said cylinders;

a plurality of pistons mounted in respective ones of said cylinders formed into said cylinder block, wherein said pistons are moveable within respective ones of said cylinders for pulling fluid into and pushing fluid out of said cylinders through respective ones of said flow ports;

a port plate for engaging said cylinder block and passing the hydraulic fluid from respective ones of said fluid flow ports to a pump suction port and to a pump discharge port corresponding to angular positions of said cylinder block rotating with said drive shaft;

a swash plate adapted to engage said plurality of pistons and move said pistons within said cylinders in response to said cylinder block rotating with said drive shaft, wherein said swash plate urges said pistons to press the hydraulic fluid from within said cylinder block when respective ones of said pistons are disposed in proximity to said pump suction port, and to draw hydraulic fluid into said cylinder block when respective ones of said pistons are disposed in proximity to said pump suction port;

wherein said swash plate is pivotally mounted within said pump housing for angularly moving about an axis to vary lengths of stroke for said pistons within said cylinder block to determine displacements for said pump;

wherein said swash plate is angularly movable over a neutral, center line position to operate said pump in a reverse flow direction in which the hydraulic fluid passes through said pump discharge port, into said cylinder block, and then through said pump suction port to power said pump to drive said prime mover; and a positioning system which includes proximity sensors for determining when said first ram and said second ram are disposed in selected reference positions, said sensors disposed within respective ones of said first ram pump and said second ram pump for determining angles at which said swash plates are disposed for determining corresponding displacements for said first ram pump and said second ram pump, and wherein said cylinder blocks are turned at at least one known angular speed and said at least one control unit is configured for calculating positioning of said first ram and said second ram from said selected reference positions and determined total flow rates of hydraulic fluid through said first ram pump and said second ram pump.

9. A dual well hydraulic pumping unit for removing well fluids from a first well and a second well, comprising:

a drive motor having a rotary drive shaft for turning in a first angular direction;

a reservoir for a hydraulic fluid;

a first sucker rod assembly disposed in the first well for removing the well fluids from the first well;

a first ram connected to said first sucker rod assembly for moving in an upstroke and moving said first sucker rod assembly from a downward position to an upward position, and moving in a downstroke with said first sucker rod assembly moving from said upward position to said downward position;

a second sucker rod assembly disposed in the second well for removing the well fluids from the second well;

a second ram connected to said second sucker rod assembly for moving in an upstroke and moving said second sucker rod assembly from a lowered position to a raised position, and moving in a downstroke with said second sucker rod assembly moving from said raised position to said lowered position;

a first ram pump connected to said rotary drive shaft, said first ram pump having a first ram pump suction port connected to said reservoir and a first ram pump discharge port connected to said accumulator and said first ram for transferring the hydraulic fluid into said first ram and moving said first ram from said downward position to said upward position during the upstroke of said first ram, and transferring the hydraulic fluid into said reservoir during the downstroke of said first ram pump;

a second ram pump connected to said rotary drive shaft, said second ram pump having a second ram pump suction port connected to said reservoir and a second ram pump discharge port connected to said accumulator and said second ram for transferring the hydraulic fluid into said second ram and moving said second ram from said lowered position to said raised position during the upstroke of said second ram, and transferring the hydraulic fluid into said reservoir during the downstroke of said second ram pump; and at least one control unit adapted for controlling flow rates of the hydraulic fluid through said first ram pump and said second ram pump, and adapting said first ram pump for pumping the hydraulic fluid into said first ram during the upstroke of said first ram, and during the downstroke of said first ram passing the hydraulic from said first ram into said reservoir and turning said rotary shaft in said first angular direction to power said second ram pump in response to pressures within said first ram provided by the weight of said first sucker rod assembly in combination with said drive motor, and adapting said second ram pump for pumping the hydraulic fluid into said second ram during the downstroke of said first ram and the upstroke of said second ram, and turning said rotary shaft in said first angular direction to power said second ram pump in response to pressure within said second ram provided by the weight of said second sucker rod assembly in combination with said drive motor; and wherein should pump down be encountered in one of the first and second wells, defining a pumped down well, said at least one control unit will provide pump down control by changing at least one of a stroke length and a stroke rate of the pumped down well and synchronizing the pumped down well and the other of the first and second well such that they have substantially the same period time cycle, such that the pumped down well and the other well reverse directions at approximately the same time.

10. The dual well hydraulic pumping unit according to claim 9, wherein during pump down conditions, the stroke lengths of the pumped down well and the other well are constant; the pumped down well and the other well are synchronized to have the same period time cycle when the stroke rate of the pumped down well is reduced by slowing a stroke rate of the other well proximate to when direction is reversed; and the stroke rate of the other well is slowed down at the beginning of a next stroke until the pumped down well finishes its current stroke and begins a subsequent stroke.

11. The dual well hydraulic pumping unit according to claim 9, wherein during pump down conditions, the pumped down well and the other well are synchronized to have the same period time cycle by changing the stroke length and the stroke rate of the pumped down well by the same percentage such that the pumped down well period cycle time remains constant; and wherein during pump down conditions the pumped down well and the other well reverse directions at the same time, such that the upstroke of the first well begins simultaneously with the downstroke of the second well.

12. The dual well hydraulic pumping unit according to claim 11, wherein the at least one control unit operates both the first well and the second well to independently determine when pump down conditions are encountered for one or both of the first and second wells, and then separately for each of the first well and the second well adjusts the stroke rate and the stroke length of the respective wells.

13. The dual well hydraulic pumping unit according to claim 12, wherein the at least one control unit, separately and independently for each of the first well and the second well, decreases the stroke length and the stroke rate by 1.5% per stroke when pump down is detected and increases by 3% per stroke when pump down is not detected until a constant fluid level is reached.

14. The dual well hydraulic pumping unit according to claim 9, wherein said first ram pump and said second ram pump each further comprise:

a pump housing;

a drive shaft rotatably mounted in said pump housing;

a cylinder block mounted to said drive shaft for rotating with said drive shaft, said cylinder block having a plurality of cylinders formed therein, and a plurality of flow ports in fluid communication with respective ones of said cylinders;

a plurality of pistons mounted in respective ones of said cylinders, wherein said pistons are moveable within respective ones of said cylinders for pulling fluid into and pushing fluid out of said cylinders through respective ones of said flow ports;

a port plate for engaging said cylinder block and passing the hydraulic fluid from respective ones of said fluid flow ports to a pump suction port and to a pump discharge port corresponding to angular positions of said cylinder block rotating with said drive shaft;

a swash plate adapted to engage said plurality of pistons and move said pistons within said cylinders in response to said cylinder block rotating with said drive shaft, wherein said swash plate urges said pistons to press the hydraulic fluid from within said cylinder block when respective ones of said pistons are disposed in proximity to said pump suction port, and to draw hydraulic fluid into said cylinder block when respective ones of said pistons are disposed in proximity to said pump suction port;

wherein said swash plate is pivotally mounted within said pump housing for angularly moving about an axis to vary lengths of stroke for said pistons within said cylinder block to determine displacements for said pump;

wherein said swash plate is angularly movable over a neutral, center line position to operate said pump in a reverse flow direction in which the hydraulic fluid passes through said pump discharge port, into said cylinder block, and then through said pump suction port to power said pump to drive said rotary drive shaft; and a control member mounted in said pump housing and adapted for angularly moving said swash plate about said axis, wherein said control member comprises a control piston, and said control piston is actuated by the hydraulic fluid;

a bias member for urging said swash plate into a first angular position respective to said drive shaft;

wherein said neutral, centerline position for said swash plate is a plane of said swash plate for engaging said pistons disposed generally perpendicular to a longitudinal axis of said drive shaft about which said drive shaft rotates; and a positioning system which includes proximity sensors for determining when said first ram and said second ram are disposed in selected reference positions, said sensors disposed within respective ones of said first ram pump and said second ram pump for determining angles at which said swash plates are disposed for determining corresponding displacements for said first ram pump and said second ram pump, and wherein said cylinder blocks are turned at at least one known angular speed and said at least one control unit is configured for calculating positioning of said first ram and said second ram from said selected reference positions and determining total flow rates of hydraulic fluid through said first ram pump and said second ram pump.

15. A method for operating a pumping unit, comprising the steps of: providing a first hydraulic ram and a first sucker rod assembly, the first sucker rod assembly and the first hydraulic ram are located at a first well and configured for lifting well fluids from within the first well, and a second hydraulic ram and a second sucker rod assembly, the second sucker rod assembly and the second hydraulic ram are located at a second well and configured for lifting well fluids from within the second well;

further providing at least one control unit, a drive motor, a first ram pump, a second ram pump, a reservoir for a hydraulic fluid, wherein the control unit, the drive motor, the reservoir, the first ram pump, and the second ram pump are configured for moving the hydraulic fluid between the reservoir, the first hydraulic ram and the second hydraulic ram for lifting and lowering respective ones of the first and second sucker rod assemblies;

releasing the hydraulic fluid from the first hydraulic ram into the first ram pump and to the reservoir, and thereby providing mechanical power in combination with the drive motor for turning a rotary shaft which powers the second ram pump to move the hydraulic fluid into the second hydraulic ram;

releasing the hydraulic fluid from the second hydraulic ram into the first ram pump and to the reservoir, and thereby providing mechanical power in combination with the drive motor for turning the rotary shaft which powers the second ram pump to move the hydraulic fluid into the second hydraulic ram;

controlling the flow of the hydraulic fluid from the first hydraulic ram, through the first ram pump and into the reservoir, and the flow of the hydraulic fluid from the second hydraulic ram, through the second ram pump and into the reservoir; and wherein first potential energy is recovered from the first sucker rod assembly when disposed in a lifted position and used to operate the second ram pump for assisting in an upstroke of the second hydraulic ram, and second potential energy is recovered from the second sucker rod assembly when disposed in a lifted position and used to operate the first ram pump for assisting in an upstroke of the first hydraulic ram;

determining whether pump down conditions are being encountered in one of the first and second wells, which when encountered defines a pumped down well; and when pump down is detected, providing pump down control with the at least one control unit by changing at least one of a stroke length and a stroke rate of the pumped down well and synchronizing the pumped down well and the other well of the first and second wells such that they have substantially the same period time cycle, such that the pumped down well and the other well reverse directions at approximately the same time.

16. The method for operating a pumping unit according to claim 15, wherein the step of providing pump down control further comprises the pumped down well and the other well being synchronized to have the same period time cycle when the stroke rate of the pumped down well is reduced by slowing a stroke rate of the other well proximate to when direction is reversed.

17. The method for operating a pumping unit according to claim 16, wherein the step of providing pump down control further comprises slowing the stroke rate of the other well at the beginning of a next stroke until the pumped down well finishes its current stroke and begins a subsequent stroke.

18. The method for operating a pumping unit according to claim 15, wherein the step of providing pump down control further comprises the steps of:

synchronizing the pumped down well and the other well to have the same period time cycle by changing the stroke length and the stroke rate of the pumped down well by the same percentage such that the pumped down well period cycle time remains constant; and reversing the directions of the pumped down well and the other well at the same time, such that the upstroke of the first well begins simultaneously with the downstroke of the second well.

19. The method for operating a pumping unit according to claim 18, wherein the step of determining whether pump down conditions are being encountered and the step of providing pump down control further comprise the steps of:

independently determining for the first well and the second well when pump down conditions are encountered for each of the first well and the second wells; and then separately for each of the first well and the second well adjusting the stroke rate and the stroke length of the respective well according to whether pump down conditions are being encountered.

20. The method for operating a pumping unit according to claim 19, wherein the step of providing pump down control further comprises the steps of:

separately and independently for each of the first well and the second well, decreasing the stroke length and the stroke rate by 1.5% per stroke when pump down is detected; and separately and independently for each of the first well and the second well, increasing by 3% per stroke when pump down is not detected until a constant fluid level is reached.

* * * * *